US010668503B2

(12) United States Patent
Andersen

(10) Patent No.: US 10,668,503 B2
(45) Date of Patent: Jun. 2, 2020

(54) TRANSFER CONVEYOR ASSEMBLY FOR A SCREENING APPARATUS

(71) Applicant: AAA Screens Pty Ltd, Southport (AU)

(72) Inventor: John Andersen, Runaway Bay (AU)

(73) Assignee: AAA SCREENS PTY LTD, Oxenford (AU)

( * ) Notice: Subject to any disclaimer, the term of this patent is extended or adjusted under 35 U.S.C. 154(b) by 81 days.

(21) Appl. No.: 15/798,359

(22) Filed: Oct. 30, 2017

(65) Prior Publication Data

US 2018/0065153 A1 Mar. 8, 2018

Related U.S. Application Data

(63) Continuation of application No. 14/383,917, filed as application No. PCT/AU2013/000230 on Mar. 11, 2013, now Pat. No. 9,808,834.

(30) Foreign Application Priority Data

Mar. 9, 2012 (AU) ..... 2012900959

(51) Int. Cl.
*B07B 13/16* (2006.01)
*B07B 1/00* (2006.01)
*B07B 15/00* (2006.01)

(52) U.S. Cl.
CPC ..... *B07B 13/16* (2013.01); *B07B 1/005* (2013.01); *B07B 15/00* (2013.01); *B07B 2201/04* (2013.01)

(58) Field of Classification Search
CPC ..... B07B 2201/04; B07B 1/46; B07B 15/00; B07B 13/16; B07B 1/005
See application file for complete search history.

(56) References Cited

U.S. PATENT DOCUMENTS

| | | | |
|---|---|---|---|
| 1,229,812 | A | 6/1917 | Sturtevant |
| 2,276,333 | A | 3/1942 | Ovestrud |
| 3,016,203 | A | 1/1962 | Sears et al. |
| 3,622,089 | A | 11/1971 | Quinn |
| 3,841,570 | A | 10/1974 | Quinn |
| 3,915,852 | A | 10/1975 | Butzow |
| 4,105,544 | A | 8/1978 | Stevick |
| 4,383,651 | A | 5/1983 | Couperius |
| 4,598,875 | A | 7/1986 | Bronson et al. |
| 6,354,524 | B1 | 3/2002 | Nakayama et al. |
| 6,626,608 | B2 | 9/2003 | Olynyk |

(Continued)

FOREIGN PATENT DOCUMENTS

| | | |
|---|---|---|
| FR | 907855 | 3/1946 |
| JP | 09-085174 A | 3/1997 |

(Continued)

*Primary Examiner* — Michael C McCullough
(74) *Attorney, Agent, or Firm* — Rankin, Hill & Clark LLP

(57) ABSTRACT

A transfer conveyor assembly for a screening apparatus includes at least one transfer conveyor that is oriented transversely with respect to a feed direction of the screening apparatus and is configured to receive material from at least one respective screen deck of the screening apparatus. At least one intermediate transfer conveyor is positioned with respect to at least one further screen deck of the screening apparatus to receive material from the at least one further screen deck to feed material to a position away from the at least one transfer conveyor in a discharge direction of the screening apparatus.

10 Claims, 41 Drawing Sheets

(56) References Cited

U.S. PATENT DOCUMENTS

| | | | | |
|---|---|---|---|---|
| 6,889,846 | B2 | 5/2005 | Olsen et al. | |
| 6,935,587 | B2 | 8/2005 | Brock et al. | |
| 7,143,968 | B2 | 12/2006 | Brock et al. | |
| 7,422,116 | B2 | 9/2008 | Douglas | |
| 7,665,614 | B2 | 2/2010 | Malmberg | |
| 7,971,817 | B1 | 7/2011 | Rossi, Jr. | |
| 8,162,245 | B2 * | 4/2012 | Sauser | B02C 21/02 241/76 |
| 8,505,738 | B2 | 8/2013 | O'Keeffe et al. | |
| 9,808,834 | B2 * | 11/2017 | Andersen | B07B 1/005 |
| 2004/0251351 | A1 | 12/2004 | Douglas et al. | |
| 2008/0041984 | A1 * | 2/2008 | Sauser | B02C 21/02 241/75 |

FOREIGN PATENT DOCUMENTS

| | | | |
|---|---|---|---|
| JP | 10-323621 | A | 12/1998 |
| JP | 11-197534 | A | 7/1999 |
| KR | 100681842 | B1 | 12/2006 |
| WO | 2003/004176 | | 1/2003 |
| WO | 2005/063398 | | 7/2005 |
| WO | 2007/093645 | | 8/2007 |

* cited by examiner

TRANSFER CONVEYOR ASSEMBLY FOR A SCREENING APPARATUS

RELATED APPLICATIONS

The present application is a continuation patent application of U.S. patent application Ser. No. 14/383,917, which is a national stage of international patent application no. PCT/AU2013/000230, filed on Mar. 11, 2013, which claims the benefit of Australian provisional patent application 2012900959, filed Mar. 9, 2012, the contents of all which are herein incorporated by reference.

FIELD OF THE INVENTION

Various embodiments of a transfer conveyor assembly for a screening apparatus, a mobile screening apparatus and a method of screening material are described herein. The screening apparatus relates, not exclusively, to screening aggregates, crushed rock or similar material at locations such as quarries, construction sites and surface mining operations.

BACKGROUND TO THE INVENTION

Mobile screening apparatus used in quarries and surface mining often make use of a number of superimposed decks. Each deck incorporates a screen of a different mesh size so that material to be screened can be divided into different sizes. The decks are usually located in a screen box. A number of conveyors can be operatively engaged with different decks to extract aggregate of different sizes depending on the location of those conveyors. The conveyors dump the aggregate into separate stockpiles.

Typically, the decks are usually horizontal or inclined for gravity-assistance. Also, the decks vibrate to enhance the screening process.

Generally, a heavy-duty crusher carries out an initial crushing process on the rock. The crushed material is then fed into a feed box and from there into the screen box. Oversize material can then be discharged into a stockpile or fed back to the crusher. Alternatively, any aggregate needing grading can be fed into the feed box.

In general, mobile screening apparatus include a centrally located power plant that is used to drive a hydraulic system for driving tracks, vibratory screen motors and possibly other equipment.

To date, mobile screening apparatus and equipment have not kept volumetric pace with larger crushing machines. As a result, a significant amount of demand has been placed on the production capacity of mobile screening apparatus, particularly the top deck of such apparatus. In most cases, the design has not changed, with the emphasis still on a major feed bin that is used to feed raw or unscreened material on to the top deck as well as recycled oversize material.

The inventor/s have found that operators spend a significant amount of time arranging various heights of conveyors and other machines, such as crushers and auxiliary screens so that they can feed material to each other. This can waste time and be costly.

At present, contractors are often required to add auxiliary screens to crushing plants to achieve a better transition from crusher to screening apparatus. However, these screens have difficulty in accommodating the material from the crushers.

Operators are required, in some cases, to add link conveyors between the crushers and the screen apparatus to enable a recycling feature. This results in additional costs and time spent in set up and additional power and fuel usage.

SUMMARY OF THE INVENTION

According to a first aspect, there is provided a mobile screening apparatus which comprises a support chassis, the support chassis being configured for carrying at least one screening assembly having a top screen deck and at least one further screen deck below the top screen deck; and at least one primary feed mechanism configured for arrangement in communication with any one or more of the top and further screen decks to feed material to be screened onto said any one or more of the top and further screen decks.

The screening apparatus may include at least one secondary feed mechanism configured for arrangement in communication with a feed end of at least one respective further screen deck below the top screen deck.

The primary and secondary feed mechanisms may be in the form of primary and secondary feed conveyors. However, it is to be appreciated that they can be in other forms, such as apron feeders.

The primary and secondary feed mechanisms may be configured for arrangement in communication with the feed ends of the respective screen decks so that material is fed into the screening assembly at a rear of the screening assembly.

The screening apparatus may include a transfer mechanism or feeder that is operatively mounted or mountable on the screening assembly and is displaceable with respect to the screening assembly to be in operative communication with a selected deck of the screening assembly, the feeder being configured to receive material from the, or each, secondary feed conveyor so that that material is fed onto the selected deck.

The inventor(s) envisages that the apparatus can be supplied without the conveyor(s) or an apron feeder(s), for example. In that case, the primary feed mechanism may be the transfer mechanism or feeder.

The feeder may be in the form of a feed chute that is hydraulically or manually adjustable with respect to the screening assembly.

The at least one further screen deck may be a bottom screen deck and at least one intermediate screen deck, between the top and bottom decks, the decks having feed and discharge ends and being adjustable between horizontal and inclined orientations in which the feed ends are positioned above the discharge ends in their operative positions. However, it will be appreciated that the screen decks may also be horizontally operative screen decks. In some cases, it may be desirable that the screen decks be horizontally oriented during operation for the purposes of stability and limiting overall height of the apparatus.

Thus, the conveyors and feed mechanism may be configured for use with an operatively horizontal screening assembly.

The apparatus may include a transfer assembly configured for arrangement in communication with a discharge end of the screening assembly. The transfer assembly may be configured for receiving and discharging at least two separate products from the screening assembly at two positions that are operatively horizontally spaced from each other. The transfer assembly may be in the form of a transfer conveyor assembly.

The apparatus may include at least two discharge conveyors for arrangement in communication with the transfer conveyor assembly at respective said positions.

The screening assembly can include four decks, for example. The transfer conveyor assembly allows two pairs of discharge conveyors to receive four separate or discrete products from the screening assembly. This can be done by having the discharge conveyors of a first pair at one of said positions and the discharge conveyors of a second pair at the other position. Those skilled in the art will appreciate that it would generally be difficult to provide for discharge conveyors at a single horizontal position with respect to the screening assembly. In order to do so, the resultant structure would be prohibitively tall. Thus, the transfer conveyor assembly provides a means whereby an overall height of the apparatus can be kept within reasonable working dimensions with the apparatus being capable of generating four separate or discrete products. Also, the apparatus allows for the use of a horizontal screening assembly, which has greater production capacity than an inclined screening assembly.

The inventor(s) envisages that the transfer assembly, as described herein, or part thereof, can be supplied separately and can thus comprise an aspect.

The, or each, screening assembly may have two superimposed intermediate screen decks so that the, or each, screening assembly has four screen decks. Instead, the, or each, screening assembly may have one intermediate screen deck so that the, or each, screening assembly has three screen decks. The, or each, screening assembly may in some cases have just two screen decks.

The transfer conveyor assembly may include a first set of two transfer conveyors in operative communication with two discharge conveyors and a second set of two transfer conveyors in operative communication with two discharge conveyors. The sets of transfer conveyors may be horizontally spaced from each other in a screening assembly feed direction so that one set of two discharge conveyors can be horizontally spaced from another set of two discharge conveyors.

The first set of two transfer conveyors may be configured to receive product from the top and the first intermediate deck, respectively, while the second set of two transfer conveyors may be configured to receive product from the second intermediate and bottom deck, respectively. The transfer conveyor assembly may include an intermediate transfer assembly interposed between each of the second intermediate and bottom decks and each of the transfer conveyors of the second set to transfer the product from the second intermediate and bottom decks to respective transfer conveyors of the second set.

The support chassis may include a central portion on which a displacement mechanism such as a pair of tracks or a set of wheels is mounted. The displacement mechanism may also be defined by a trailer. The central portion may be positioned between a front portion and a rear portion. The front portion may extend beyond the discharge ends of the screen decks and may be configured to support a power plant of the screening apparatus, allowing a zone above the central portion to be occupied by the screening assembly.

The, or each, screening assembly may be a screen box in which the screen decks are mounted. The, or each, screen box may be mounted on the chassis to be pivotal between a horizontal, inoperative condition and an inclined, operative condition. The apparatus may include a variety of configurations and layouts of screen boxes. For example, the apparatus may include one or two screen boxes. Each screen box may have two to four screen decks. The screen boxes may be positioned one on top of the other, side by side, or back to back on the chassis, depending on requirements.

The apparatus may include one or two primary feed conveyors configured to receive material to be screened, for example alluvial material, aggregate or crushed material from a primary crusher. For example, where two screen boxes are provided, the apparatus may include two primary conveyors, one for each top screen deck. A discharge end of the primary feed conveyor may be operatively connected to a feed end of the top screen deck, via the screen box, to feed the material on to the top screen deck.

The primary feed conveyor may be a radial conveyor, capable of pivotal movement towards the screen box when the screen box is horizontal and away from the feed box into an operative orientation, for example when the feed box is pivoted into the inclined, operative condition or used in the horizontal condition.

A wheeled support may be mounted on the primary feed conveyor, at or near a feed end, to accommodate that movement. The support may be pivotal between an inoperative position beneath the primary feed conveyor and an operative position in which the support can engage the ground to permit the primary feed conveyor to be wheeled into a desired position while being supported. The primary feed conveyor may thus be manipulated through 360 degrees of movement, if necessary.

Thus, the wheeled support may include one or more wheels. The wheel/s may be capable of turning to accommodate or generate the pivotal movement, or to accommodate or generate the linear movement when the conveyor is extended. The wheel may be driven hydraulically.

Instead, or in addition to the wheeled support, the primary feed conveyor may include a hanger arrangement that is configured to suspend the primary feed conveyor in its operative condition. The hanger arrangement may include a support post that extends from a slew wheel arrangement mounted on the screen box. Thus, the support post can swivel with respect to the screen box to permit manipulation of the primary feed conveyor. The support post may be capable of being folded down towards the screen box when not in use.

The primary feed conveyor may also be capable of pivotal movement with respect to the feed box to accommodate the feed box when the feed box is pivoted into its inclined, operative condition.

The support may include a jacking mechanism, which may be hydraulic, that is operable to raise or lower the feed end of the primary feed conveyor to accommodate different heights of supply points, for example those defined by crushers.

It follows that, for transport, the primary feed conveyor can effectively be folded away. At its operative destination, the primary feed conveyor can be pivoted into a suitable position with its feed end in position to receive material or aggregate to be screened and its discharge end in engagement with the feed end of the top screen deck.

The apparatus may include one secondary feed conveyor, for example in the form of a radial conveyor. The secondary feed conveyor may be similar to the primary feed conveyor in that it has a support capable of stowage and deployment as described above with reference to the primary feed conveyor. Also, it is capable of both vertical and horizontal pivotal movement with respect to the screen box.

The inventor(s) envisages that a second aspect can be directed to a feed apparatus or system for a screening assembly that comprises the primary and secondary feed conveyors and the manner in which they are arranged with respect to the screening assembly, or a similar screening assembly.

The screen box may include a transfer mechanism or feeder that is arranged at a feed end of the screen box. The transfer mechanism may be capable of displacement relative to the screen box for selective engagement with either of the decks. A discharge end of the secondary feed conveyor may be engaged with the transfer mechanism or feeder so that material discharged from the secondary feed conveyor can be fed to either of the decks, for example one of the intermediate decks and the bottom deck. The transfer mechanism may be in the form of a chute, hereinafter referred to as a feed chute.

The inventor(s) envisages that a third aspect can be directed to a transfer mechanism as described above that is configured for use with the screening assembly, or a similar screening assembly.

The apparatus may include a number of discharge conveyors. Feed ends of the discharge conveyors may be operatively engaged with discharge ends of selected decks, via the transfer assembly.

The transfer assembly can be a transfer conveyor assembly that includes at least one transverse conveyor transversely oriented with respect to both the direction from the screen assembly and positioned to receive product from the screen assembly. At least one intermediate conveyor may be positioned in line with the feed direction to receive the product from the screen assembly and to convey that product to a horizontally spaced position with respect to said at least one transverse conveyor. At least one further transverse conveyor may be horizontally spaced with respect to said at least one transverse conveyor and in communication with at least one respective intermediate conveyor.

The screening assembly can include four decks. Thus, the transfer conveyor assembly may include a first set of two, stacked transverse conveyors to receive product from two respective decks and a second set of two further stacked transverse conveyors to receive product from two further respective decks. It follows that the transfer conveyor assembly may include two intermediate conveyors to transfer product from two decks to each of the transverse conveyors of the second set.

A discharge end of one or more discharge conveyors may be capable of operative engagement with an inlet of at least one respective crusher. The further respective crusher can include at least a secondary crusher. At least two further respective crushers can be provided in which case a tertiary crusher can be provided.

The feed end of at least one of the primary and the secondary conveyors may be configured to receive crushed material from a further crusher so that a further screening process can be carried out on previously screened and subsequently crushed material.

In an embodiment in which there are two superimposed intermediate decks, the upper is referred to as the first intermediate deck and the lower is referred to as the second intermediate deck simply for convenience. In that embodiment, the discharge conveyors may include two crusher feed conveyors in the form of a first crusher feed conveyor and a second crusher feed conveyor in communication with respective crushers.

However, it will readily be appreciated that each of the discharge conveyors can be configured to feed to separate stockpiles, as required.

A feed end of the first crusher feed conveyor may be operatively engaged with the discharge end of the top deck via a transfer conveyor, chute, or the like, while a discharge end of the first crusher feed conveyor may be operatively engaged with a feed of the secondary crusher. The primary conveyor may be configured to receive crushed material from the secondary crusher.

A feed end of the second crusher feed conveyor may be operatively engaged with the discharge end of one of the first intermediate deck, the second intermediate deck and the bottom deck via a transfer conveyor, chute or the like. A discharge end of the second crusher feed conveyor may be operatively engaged with a feed of the tertiary crusher. The secondary feed conveyor may be configured to receive crushed material from the tertiary crusher. Thus, the secondary feed conveyor can feed material from the tertiary crusher back to a selected screen deck via the feed chute.

According to a second aspect, there is provided a method of screening material using the apparatus of the first aspect, the method comprising the step of:

conveying material to be screened on to the, or each, deck of the, or each respective, screening assembly.

The method may also comprise the steps of:

screening material with the top deck such that aggregate less than a predetermined size passes to at least one other deck; and returning material from the at least one other deck to any one of the decks.

The method may comprise the step of conveying material from one of the decks to a crusher and conveying crushed material from the crusher to one of the other decks. For example, the method may comprise the step of conveying crushed material from the crusher to a deck below the top deck.

Instead, the method may comprise the step of discharging oversize material from each of the decks into separate stockpiles. For example, the method may comprise the step of discharging the oversize material or product into discrete, radially arranged stockpiles.

According to a third aspect, there is provided a transfer conveyor assembly for a screening apparatus, the transfer conveyor assembly comprising:

at least one transfer conveyor that is oriented transversely with respect to a feed direction of the screening apparatus and is configured to receive material from at least one respective screen deck of the screening apparatus; and at least one intermediate transfer conveyor that is positioned with respect to at least one further screen deck of the screening apparatus to receive material from the at least one further screen deck to feed material to a position away from the at least one transfer conveyor in a discharge direction of the screening apparatus.

According to a fourth aspect, there is provided a mobile screening apparatus that comprises:

a support chassis;

a screening assembly mounted on the support chassis, the screening assembly having a top screen deck and at least one further screen deck below the top screen deck; and a transfer conveyor assembly that is configured for arrangement in communication with the screening assembly, the transfer conveyor assembly including:

at least one transfer conveyor that is oriented transversely with respect to a feed direction of the screening apparatus and is configured to receive material from at least one respective screen deck of the screening apparatus; and at least one intermediate transfer conveyor that is positioned with respect to at least one further screen deck of the screening apparatus to receive material from the at least one further screen deck to feed material to a position away from the at least one transfer conveyor in a discharge direction of the screening apparatus.

According to a fifth aspect, there is provided a method of screening material with a mobile screening apparatus which has a support chassis, a screening assembly mounted on the support chassis, the screening assembly having a top screen deck and at least one further screen deck below the top screen deck, a transfer conveyor assembly that is configured for arrangement in communication with the screening assembly, the transfer conveyor assembly including at least one transfer conveyor that is oriented transversely with respect to a feed direction of the screening apparatus and is configured to receive material from at least one respective screen deck of the screening apparatus and to feed the material onto at least one respective conveyor, and at least one intermediate transfer conveyor that is aligned with at least one further deck of the screening apparatus to receive material from the at least one further screen deck of the screening apparatus, the method comprising the steps of:

feeding material to be screened onto at least one of the screen decks;

feeding material from the at least one of the screen decks to the at least one transfer conveyor; and feeding material from the at least one further screen deck to the at least one respective intermediate conveyor.

In this specification, the word "mobile" is intended to include able to be moved with conventional equipment or capable of self-propulsion. Thus, while a number of the embodiments show the use of tracks, it is to be understood that the apparatus can be configured for transport using a conventional transport apparatus, such as a truck and trailer combination.

In this specification, the word "aggregate" is intended to include a material that has been broken up in some way or comminuted. This includes material such as that used road construction and similar. Such a material is often referred to as "road base". For example, at a quarry, rock crushing apparatus would be used to reduce the size of minerals into an "aggregate". However, the word "aggregate" is also to be understood to mean material that has not necessarily been broken up by man-made equipment.

In this specification, the words "screen deck" are intended to include a panel or screen structure that incorporates a plurality of openings, such as those that might be defined by a grid or mesh or by a series of parallel elements that is vibrated or otherwise moved to separate items of different sizes, such as an aggregate with differently sized particles or components, such as rocks or stones.

In the specification, the word "chassis" is intended to include any form of structure to which machinery or similar componentry can be connected. As such, it does not necessarily refer to a component of an assembly that is positioned beneath or below the rest of the assembly. Also, it should not be understood as being limited to some form of substructure to which mobility components are attached.

In this specification, words indicating orientation or direction not intended to be used in a limiting manner. For example, the inventor(s) envisages that various components can be supplied in various orientations and does not expect the use of words describing those orientations to be limiting. As such, such words are used for convenience only. For example, the inventor(s) envisages that the transfer conveyor assembly may of itself comprise an aspect that can be provided separately from the support chassis and screen box. As such, reference to directions associated with the screen box not to be regarded as defining the transfer conveyor assembly when supplied separately. It is to be understood that a person skilled in the art will readily appreciate how the conveyors of such an assembly should be described with reference to the screen box while being supplied separately.

Embodiments are now described, by way of examples, with reference to the accompanying drawings. The following description is for illustrative purposes only and is not intended to limit the scope of the preceding paragraphs or the appended claims.

DETAILED DESCRIPTION OF THE DRAWINGS

Figure 1:
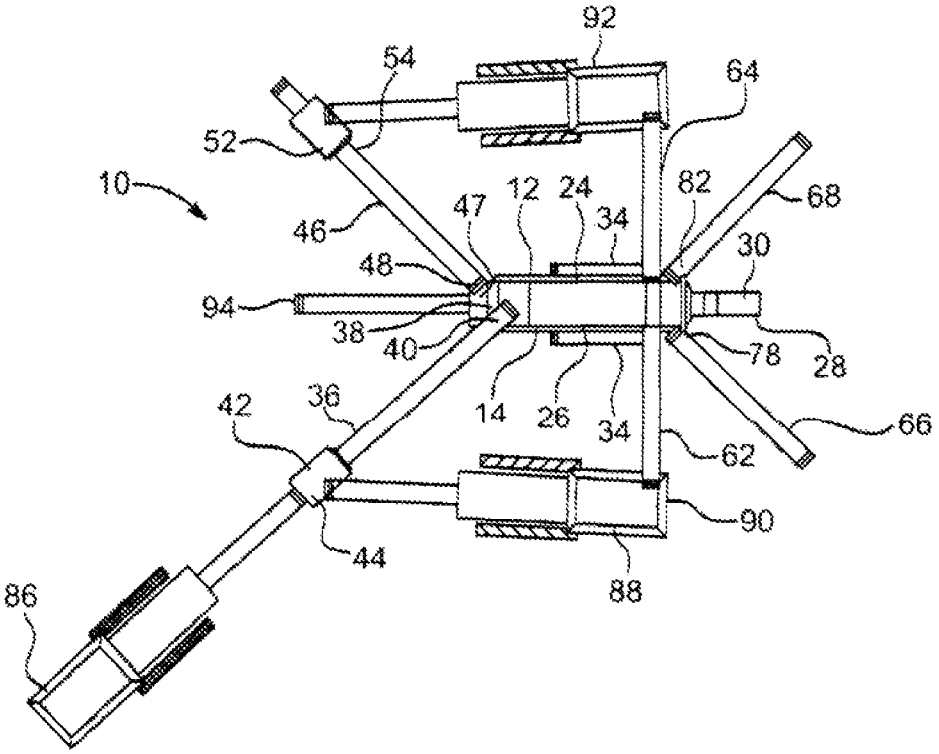
FIG. 1 shows an example of a crushing and screening layout incorporating an embodiment of a mobile screening apparatus.

In the drawings, reference numeral 10 generally indicates one example of a mobile screening apparatus.

The apparatus 10 includes a support chassis 12. A screening assembly 14 is mounted on the support chassis 12 and has a top screen deck 16, an upper or first intermediate deck 18, a lower or second intermediate deck 20 and a bottom deck 22. Each of the decks have feed and discharge ends. The screening assembly 14 can have more or less decks, depending on requirements. For example, the screening assembly 14 can have two or three decks.

The screening assembly 14 includes a screen box 24 in which the screen decks are mounted. The screen box 24 is mounted on the chassis 12 to be pivotal between a horizontal, inoperative or stowed condition and an inclined, operative condition. This can be achieved with a suitable hydraulic arrangement. The screening assembly 14 can include two or more such screen boxes, if required. For example, the screening assembly 14 can include two screen boxes. The two screen boxes can be positioned side-by-side. Instead, the two screen boxes can be positioned one on top of the other to provide a screening assembly 14 with four decks.

Figure 4:
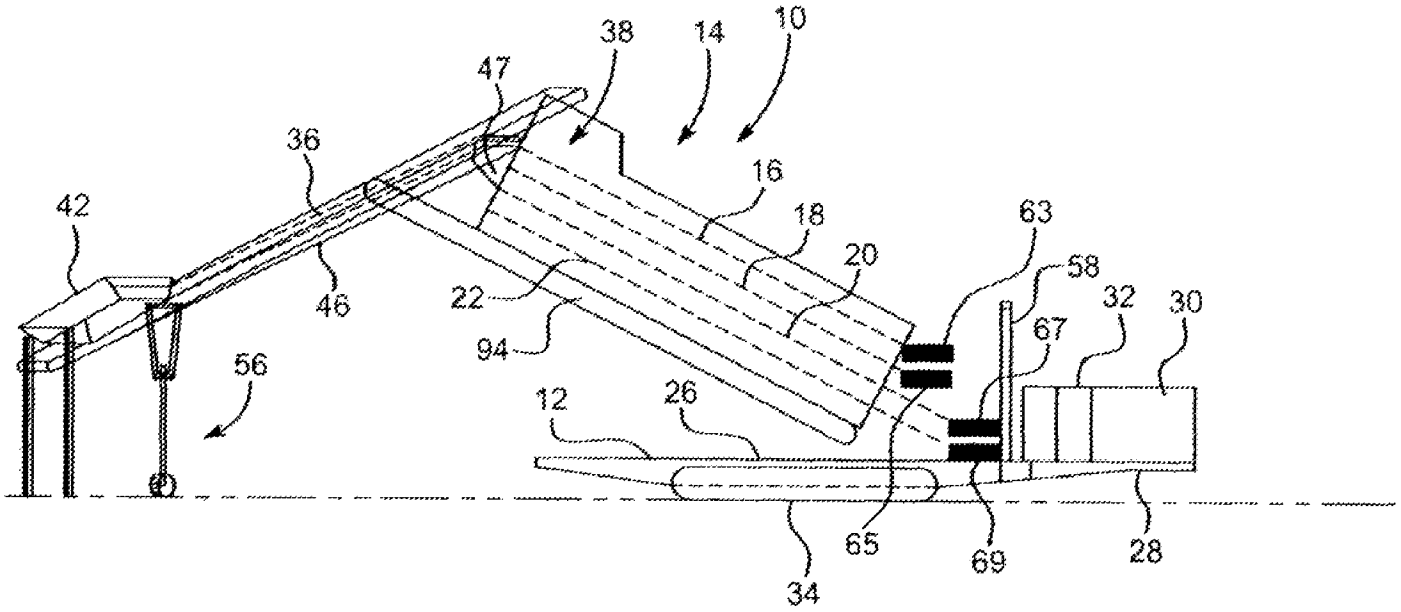
FIG. 4 shows a schematic side view of the mobile screening apparatus in a deployed or operative condition.

The chassis 12 has a central portion 26 (see FIG. 4 for example). The screen box 24 is positioned on the central portion 26. A pair of track assemblies 34 is mounted on the central portion 26. The chassis 12 has a front portion 28 that extends from the central portion 26 and is configured to support a motor and hydraulic pump assembly 30 and fuel and oil tanks 32 for the assembly 30 (FIG. 4,10). The assembly 30 is used to drive the apparatus 10 via the track assemblies 34 and also to operate hydraulic systems used to tilt the screen box 24 and drive the track assemblies 34. It will be appreciated that the chassis 12 can instead have a rear portion that extends from the central portion 26 is configured to support the motor and hydraulic pump assembly 30.

This configuration allows the use of two screen boxes 24. These can be arranged in any number of configurations, such as side-by-side, back-to-back or one on top of the other.

The apparatus 10 includes a primary feed conveyor 36 with a discharge end 40 in communication with a feed end 38 of the top screen deck 16. The apparatus 10 could include two primary feed conveyors, if required.

A hopper or chute 42 is mounted on a feed end 44 (FIG. 2) of the conveyor 36 to feed material onto the conveyor 36. For example, the chute 42 is configured to feed crushed material onto the primary feed conveyor 36.

The primary feed conveyor 36 is both horizontally and vertically pivotal with respect to the feed end 38 (shown in FIG. 4) of the top deck 16. This allows the conveyor 36 to be pivoted horizontally outwardly and inwardly between operative or deployed and inoperative or stowed conditions with respect to the screen box 24. Also, the conveyor 36 can be tilted upwardly and downwardly as the screen box 24 is tilted between its inclined, operative condition and its horizontal, stowed condition.

The apparatus 10 includes a secondary feed conveyor 46 with a discharge end 48 in communication with a feed end 50 (FIG. 22) of the first intermediate deck 18. Depending on requirements, the discharge end 48 can be in communication with a feed end 60 of the second intermediate deck 20.

Figure 17:
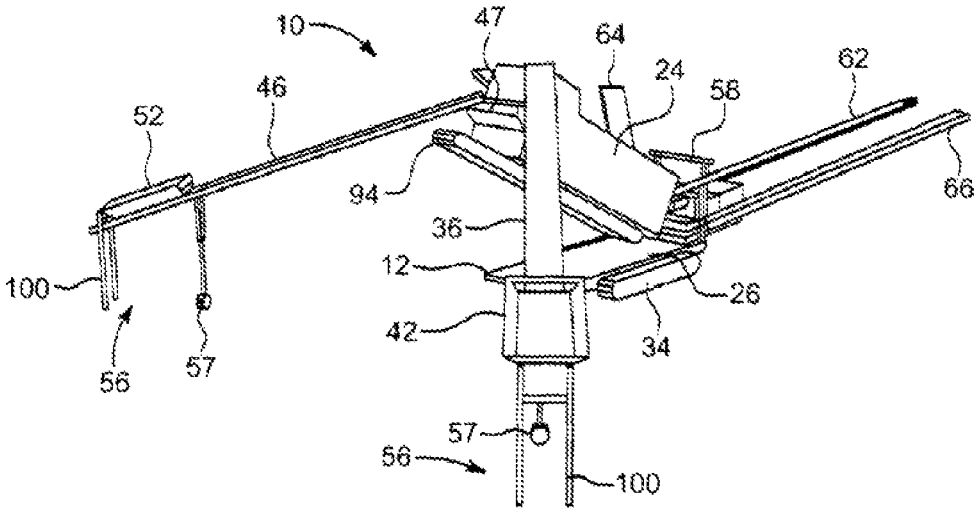
FIG. 17 shows a schematic three-dimensional rear view of an example of the mobile screening apparatus in a deployed condition.
Figure 18:
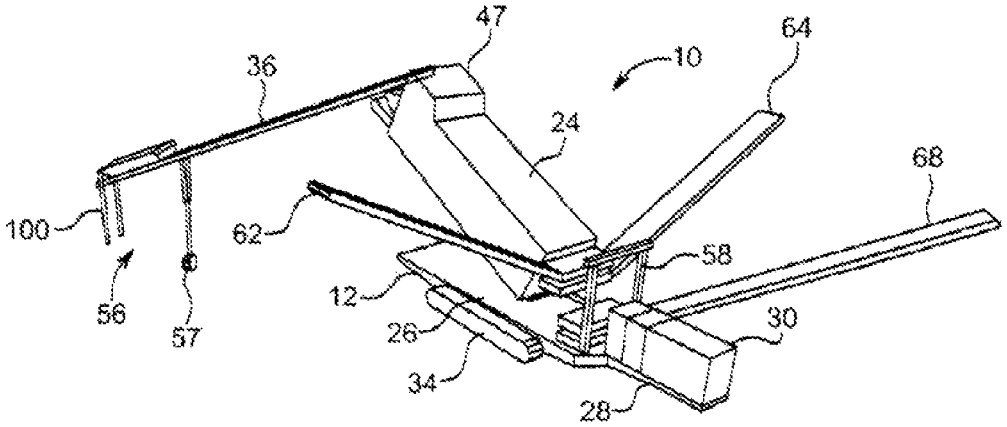
FIG. 18 shows a schematic three-dimensional front view of the mobile screening apparatus in a deployed condition.

In particular, the apparatus 10 includes a transfer mechanism in the form of a feed chute 47 (FIGS. 17 to 19, for example) that is mounted on a rear or feed end of the screen box 24. The feed chute 47 is displaceable in the direction of arrows 49 relative to the screen box 24 to permit an outlet of the chute 47 selectively to engage feed ends of the decks at a feed or rear end of the screen box 24. It follows that the feed chute 47 can be used to select which of the decks is to receive material from the secondary feed conveyor 46. The feed chute 47 is hydraulically operated, but can also be manually adjusted to direct material to a selected deck from the rear or feed end of the screen box 24. It is to be appreciated that the transfer mechanism can take other forms, the requirement being that a deck can be selected to receive material from the secondary feed conveyor 46.

Figure 7:
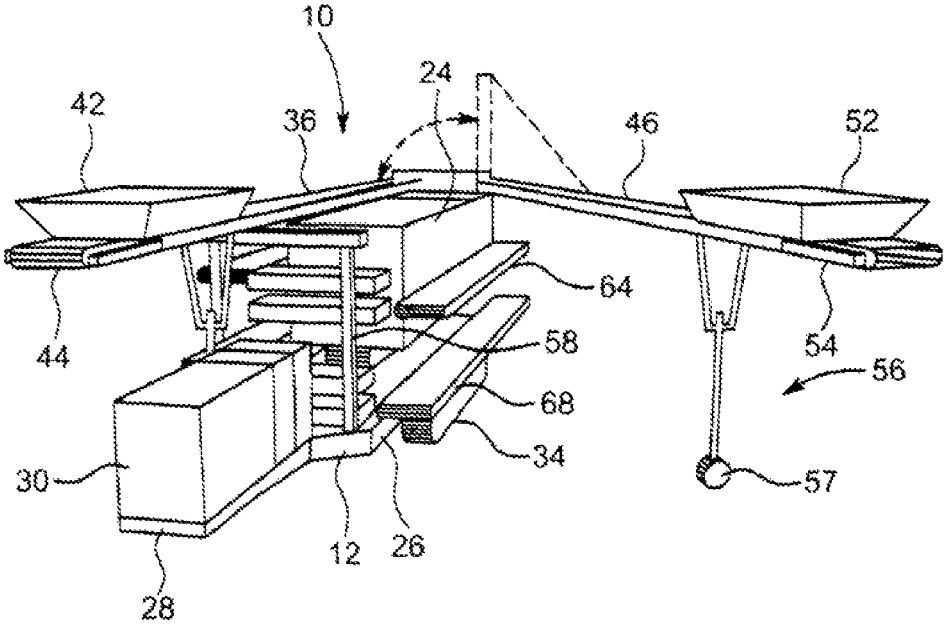
FIG. 7 shows a schematic three-dimensional view of the mobile screening apparatus illustrating initial deployment of the feed conveyors.
Figure 8:
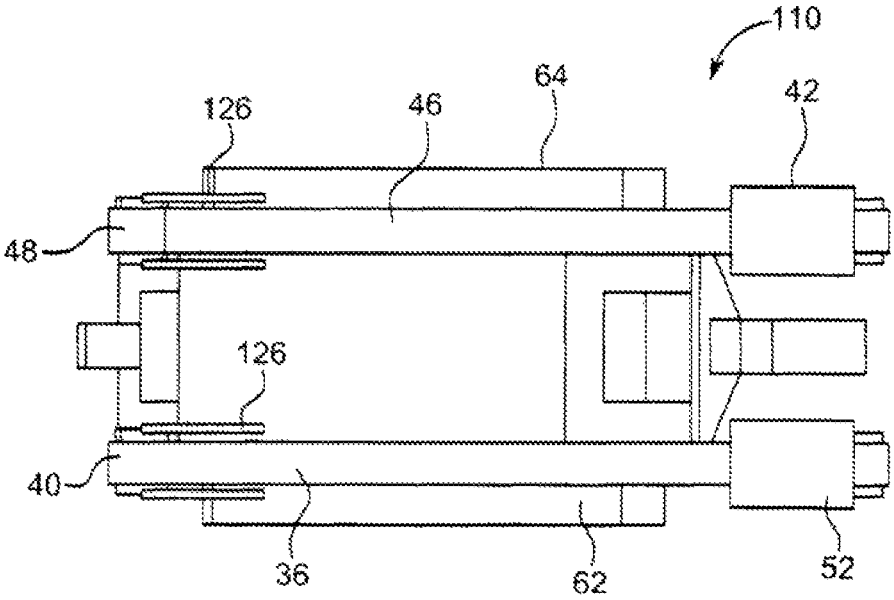
FIG. 8 shows a schematic plan view of an example of a mobile screening apparatus, in a condition for transport, with conveyors, support beams and jacking legs stowed for transport.
Figure 9:
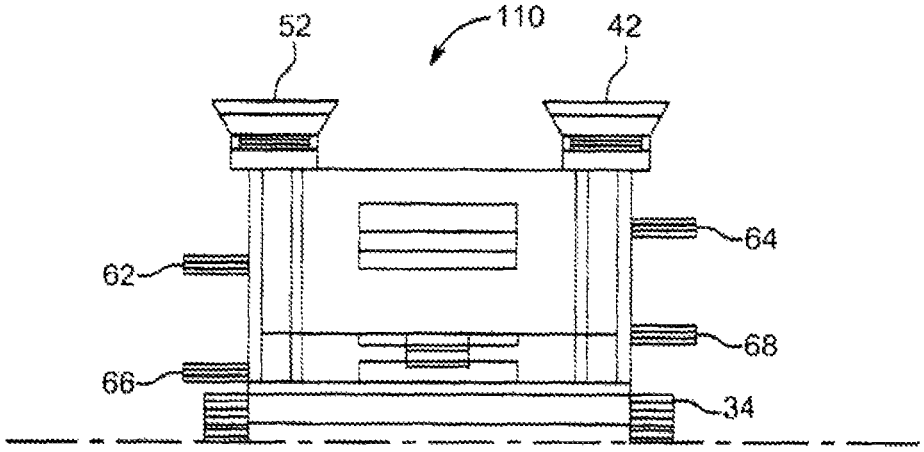
FIG. 9 shows a schematic rear view of the mobile screening apparatus of FIG. 8 in a condition for transport.
Figure 10:
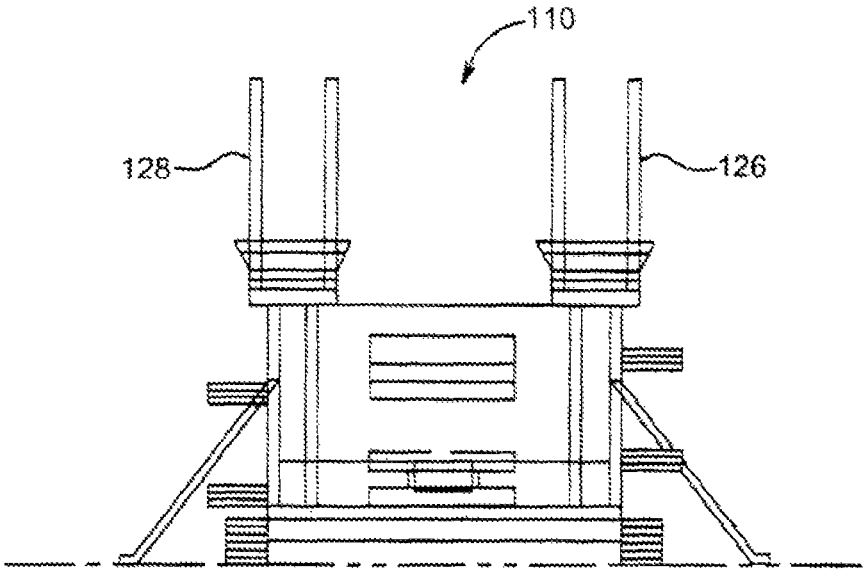
FIG. 10 shows a schematic rear view of the mobile screening apparatus of FIG. 8 in an operational condition.

A hopper or chute 52 is mounted on a feed end 54 of the conveyor 46. As with the primary conveyor 36, the secondary conveyor 46 is both horizontally and vertically pivotal with respect to the feed end 50 of the first intermediate deck 18 at the chute 47. This allows the conveyor 46 to be pivoted horizontally outwardly and inwardly between operative or deployed and inoperative or stowed conditions with respect to the feed box 24 (FIG. 7). Also, the conveyor 46 can be tilted upwardly and downwardly as the screen box 24 is tilted between its inclined, operative condition and its horizontal, stowed condition.

Figure 5:
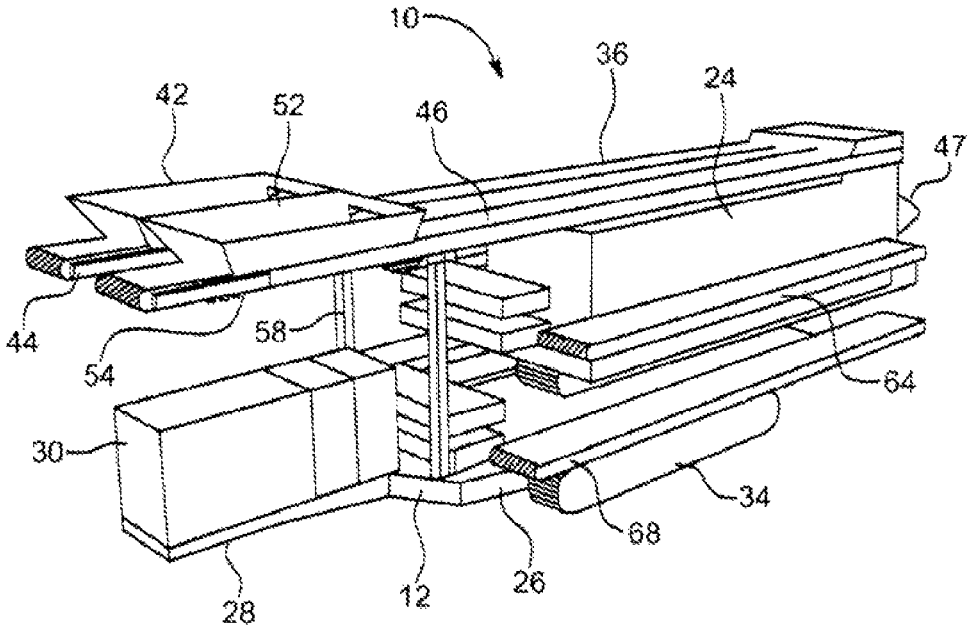
FIG. 5 shows a schematic three-dimensional view of the mobile screening apparatus in a stowed condition, for transport.
Figure 6:
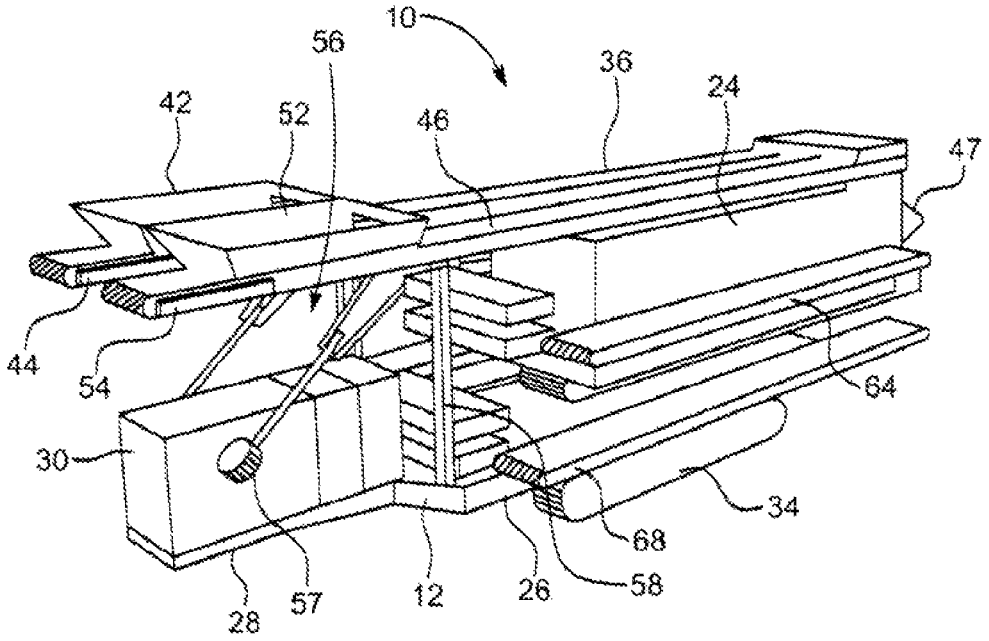
FIG. 6 shows a schematic three-dimensional view of the mobile screening apparatus in a stowed condition, illustrating initial deployment of supports for feed conveyors.

FIGS. 5 and 6 show the conveyors 36, 46 in their stowed conditions with the screen box 24 in a horizontal, stowed position. In that condition, the conveyors 36, 46 extend over the screen box 24 and the assembly 30. A support structure or frame 58 is mounted on the chassis 12 to support the conveyors 36, 46 in their stowed condition. If necessary, the conveyors 36, 46 can be detachably connected to the support chassis 12 to be removed for transport. It will be appreciated that this can allow the overall height of the apparatus 10 to be reduced, depending on legal and other requirements in various jurisdictions.

A support assembly 56 is mounted on each of the primary and secondary feed conveyors 36, 46. Each support assembly 56 is pivotal with respect to its associated conveyor to be pivoted downwardly (FIG. 6) towards an operative position and upwardly into a stowed, inoperative position. Each support assembly 56 has a wheel 57 that engages the ground so that the conveyors 36, 46 can travel over the ground while being supported. Each support assembly 56 includes a hydraulic jacking mechanism to permit height adjustment of the associated hopper or chute 42, 52 to suit the height of the respective crushers.

The wheel 57 is hydraulically driven by the assembly 30 so that the conveyors 36, 46 can be driven into their operative or deployed conditions. The wheel 57 is also capable of being turned to accommodate circular movement or steering of the conveyors 36, 46 or linear movement of the conveyors 36, 46 towards and away from the screen box 24. Turning of the wheel 57 can be hydraulically actuated.

Figure 2:
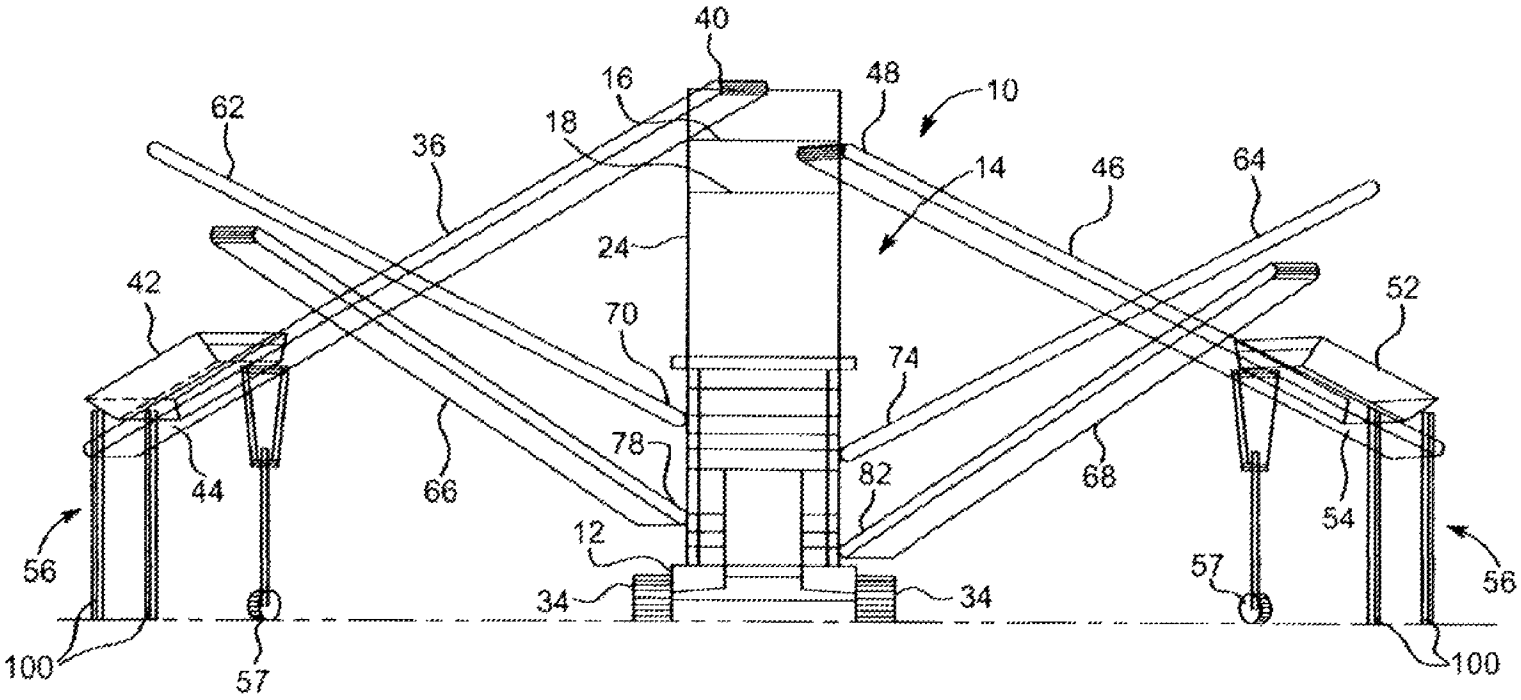
FIG. 2 shows a schematic front view of the mobile screening apparatus in a deployed or operative condition.
Figure 3:
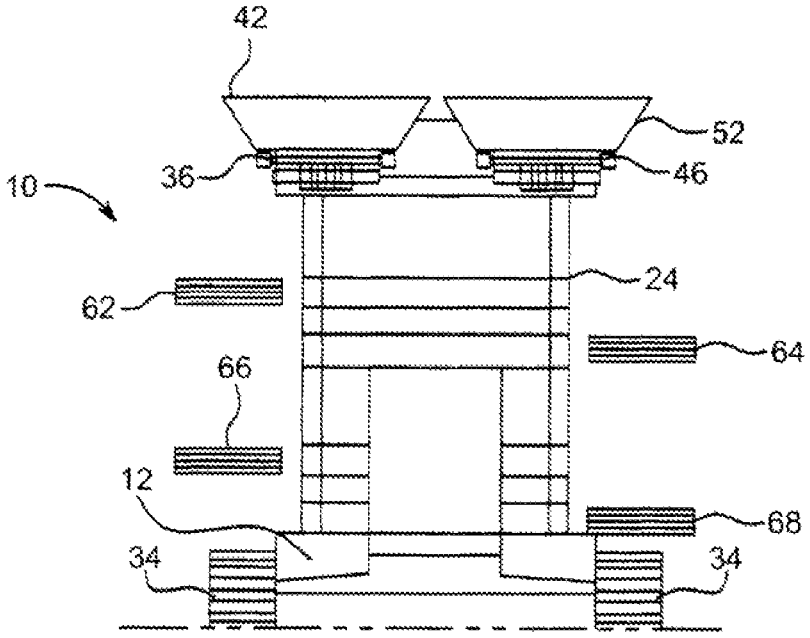
FIG. 3 shows a schematic front view of the mobile screening apparatus in a stowed or inoperative condition for transport.
Figure 19:
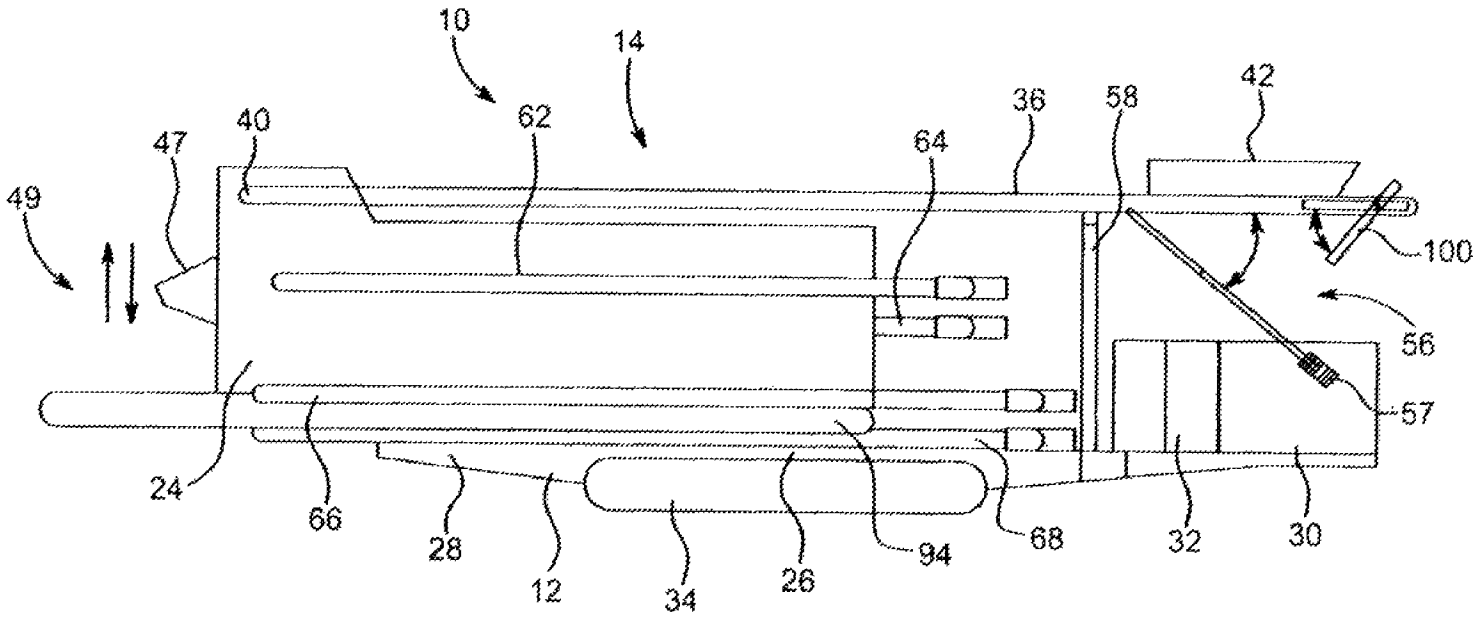
FIG. 19 shows a schematic side view of the mobile screening apparatus illustrating deployment of supports for the feed conveyors.
Figure 20:
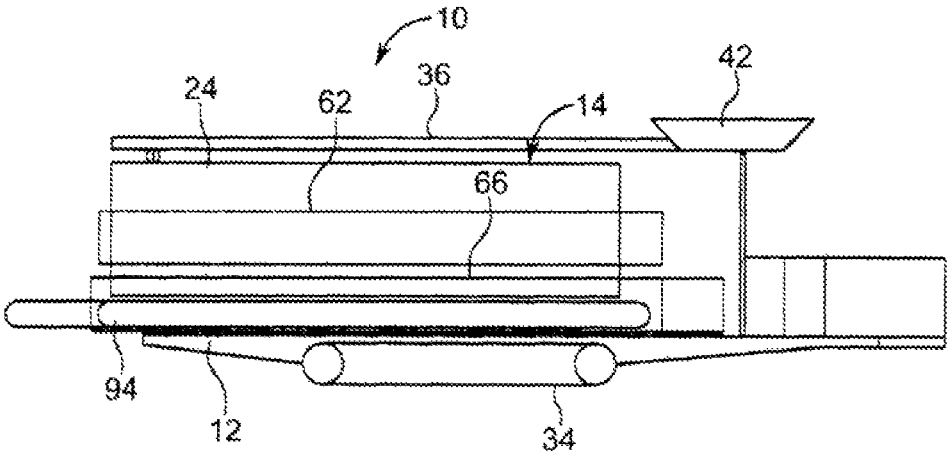
FIG. 20 shows a schematic side view of the mobile screening apparatus illustrating location of the conveyors in their stowed conditions.

Each support assembly 56 includes a pair of levelling legs 100 that are mounted on the respective conveyors 36, 46 (FIGS. 2 and 19). The levelling legs 100 are hydraulically operated and are capable of both pivotal and linear movement with respect to the conveyors 36, 46. The legs 100 are deployed once the conveyors 36, 46 are in their operative positions in order to stabilise the conveyors 36, 46, in use.

It is to be noted that the conveyors 36, 46 can vary in width and drive capacity to suit different applications and production requirements.

It follows that, for transport, the feed conveyors 36, 46 can effectively be folded away. At its operative destination, the feed conveyors 36, 46 can be pivoted into a suitable position with their feed ends 44, 54 in engagement or communication with crushers.

The apparatus 10 includes five discharge conveyors. These are conveniently referred to as a first side conveyor 62, a second side conveyor 64, a first radial conveyor 66 and a second radial conveyor 68. They also include a fines conveyor 94.

The first side or crusher feed conveyor 62 has a feed end 70 (FIG. 2) in communication with a discharge end of the top deck 16 via a first transfer conveyor 63 or transfer chute or similar. The second side or crusher feed conveyor 64 has a feed end 74 in communication with a discharge end of the first intermediate deck 18 via a second transfer conveyor 65 or transfer chute or the like. The first radial conveyor 66 has a feed end 78 in communication with a discharge end of the second intermediate deck 20 via a third transfer conveyor 67 or transfer chute or the like. The second radial conveyor 68 has a feed end 82 in communication with a discharge end of the lower deck 22 via a fourth transfer conveyor 69.

The primary feed conveyor 36 can be positioned so that its hopper or chute 42 can be positioned to receive the product of a primary crusher, such as a jaw crusher 86. The chute 42 can also be positioned to receive the product of a secondary crusher, such as a cone crusher 88.

The secondary feed conveyor 46 can be positioned so that its hopper or chute 52 can be positioned to receive the product of a tertiary crusher, such as a VSI (Vertical Shaft Impactor) or cone crusher 92.

The apparatus 10 includes the fines conveyor 94 located below the lower deck 22 to convey fines that pass through the screen decks away from the apparatus 10. The fines conveyor 94 can be locked or engaged with the screen decks in an operative configuration (see FIG. 4, for example). The fines conveyor 94 can also be unlocked or disengaged from the screen decks, so that when the screen decks are inclined, it is possible to access the fines conveyor 94 for maintenance purposes.

The apparatus 10 can be transformed between a condition in which the conveyors and the screen box are stowed and a condition in which the conveyors and the screen box are deployed for operation. The transformation from the inoperative and operative conditions is shown in FIGS. 5 to 7. The deployment of the feed conveyors has been described above. The discharge conveyors are deployed in a similar manner.

It will be appreciated that the selection of decks and the position of the secondary feed conveyor 46 can be used to determine product size.

Figure 21:
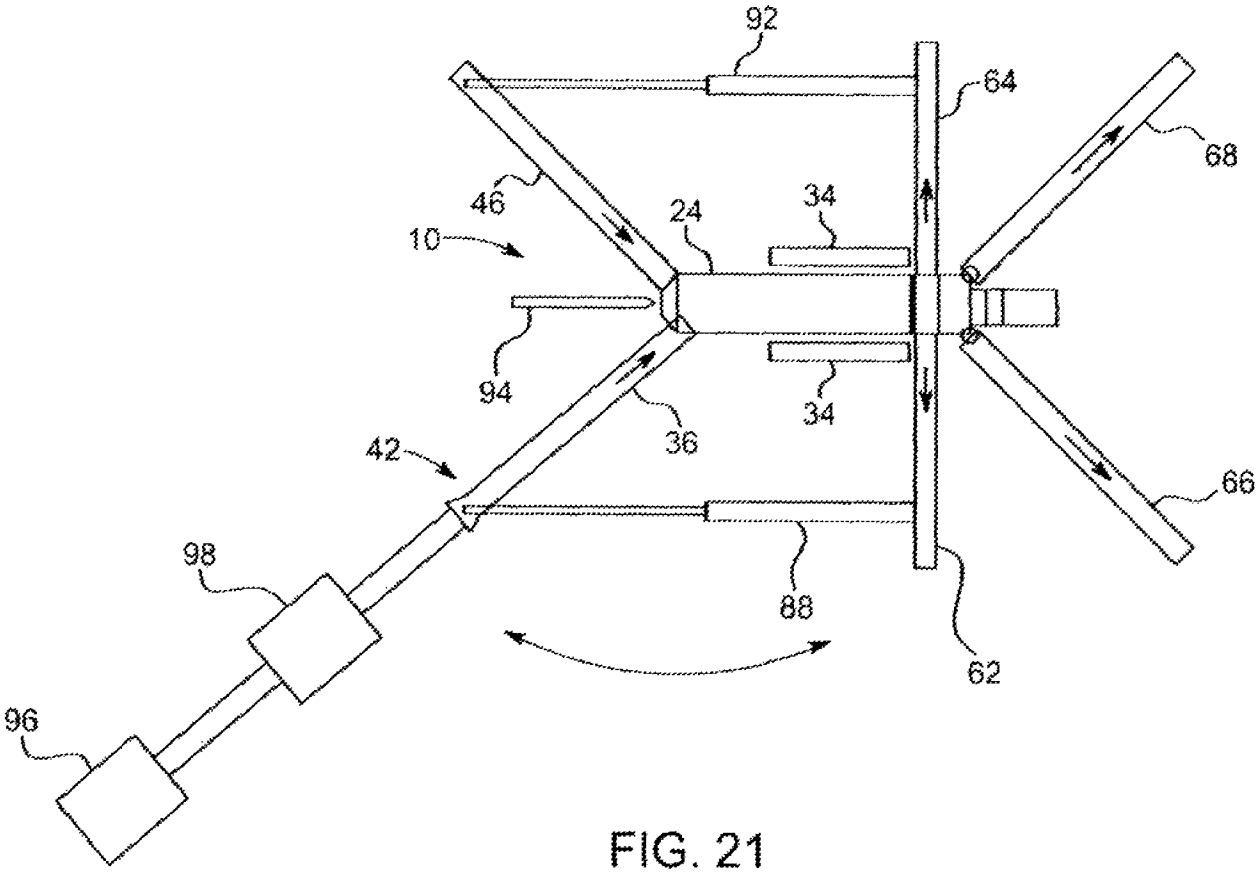
FIG. 21 shows an example of a crushing and screening layout incorporating an embodiment of a mobile screening apparatus.
Figure 22:
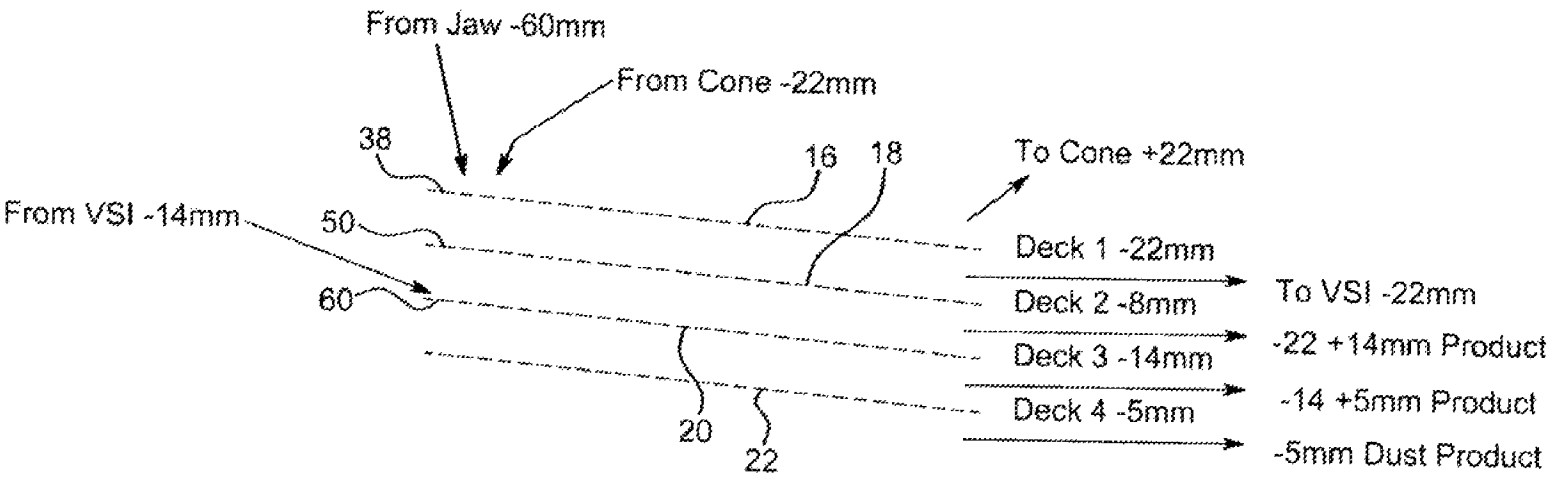
FIG. 22 shows a schematic layout of one example of a screen deck assembly of the apparatus of FIG. 21.

In FIGS. 21 and 22 there is shown the apparatus 10 used with a jaw crusher 96 that carries out an initial crushing operation on material to be processed to generate a product with an aggregate size of less than about 100 mm. That material is then fed to a cone crusher 98 to generate a product with an aggregate size of less than about 60 mm that is fed onto the top deck 16 with the conveyor 36.

The top deck 16 is configured to discharge product or material with an aggregate size greater than about 22 mm so that that material is fed to the cone crusher 88 with the conveyor 62, via the second transfer conveyor 65. The cone crusher 88 is configured to generate a product with an aggregate size of less than about 22 mm that is fed into the hopper 42 with the product from the cone crusher 98.

The first intermediate deck 18 is configured to discharge material with an aggregate size greater than about 8 mm. This material is fed to the VSI or Cone Crusher 92 with the conveyor 64, via the first transfer conveyor 63, while the remainder of the material, being fines, can pass through and avoid the VSI crusher 92. Such crushers do not operate optimally with fines.

The crusher 92 is capable of generating material with an aggregate size of less than about 14 mm.

In this configuration, the discharge end 48 of the secondary feed conveyor 46 communicates with the feed end 60 of the second intermediate deck 20 via the feed chute 47 that is appropriately positioned.

The second intermediate deck 20 is configured to discharge material with an aggregate size of greater than about 14 mm. It follows that the second intermediate deck 20 allows passage of material with an aggregate size of less than about 14 mm and generates a product with an aggregate size of between 14 mm and 22 mm. It will therefore be apparent that the top sizing of the material generated by the second intermediate deck 20 is carried out on the top deck 16 before material larger than 22 mm reaches the VSI or cone crusher 92. This can result in efficient use of the crusher 92.

The feed end 78 of the radial conveyor 66 is in communication with the discharge end of the second intermediate deck 20 via the third transfer conveyor 67 so that the product from the second intermediate deck 20 can be stockpiled.

The bottom deck 22 is configured to discharge material with an aggregate size of greater than about 5 mm. It follows that the bottom deck 22 is configured to generate a finished product which has an aggregate size between 5 mm and 14 mm. The feed end 82 of the radial conveyor 68 is in communication with the discharge end of the bottom deck 22 via the fourth transfer conveyor 69 so that the product from the bottom deck 22 can be stockpiled.

A dust product with an aggregate size of less than about 5 mm is received by the fines conveyor 94 that serves to stockpile the dust product.

Figure 23:
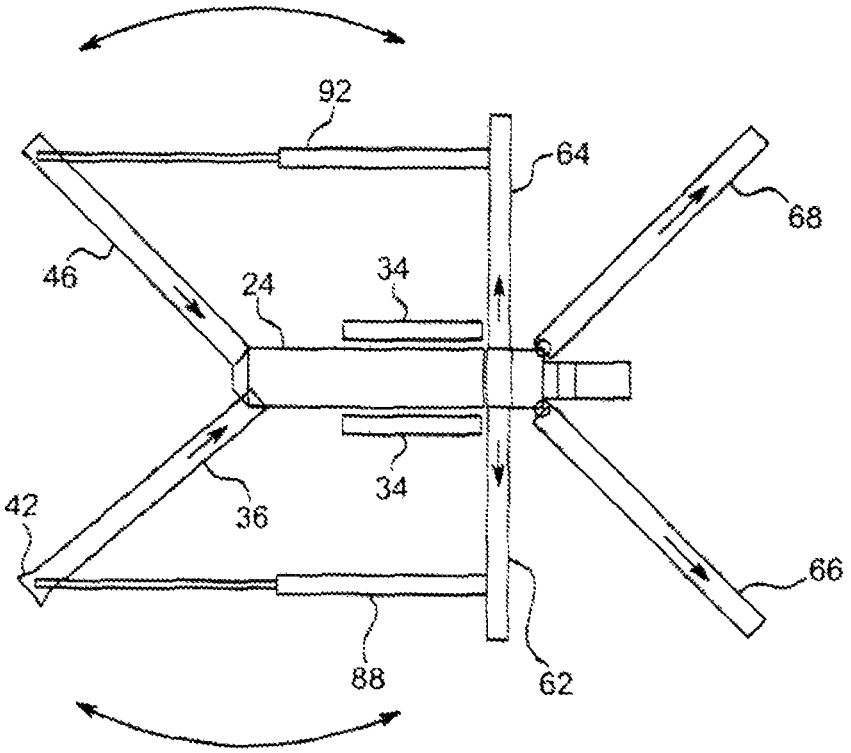
FIG. 23 shows another example of a crushing and screening layout incorporating an embodiment of a mobile screening apparatus.
Figure 24:
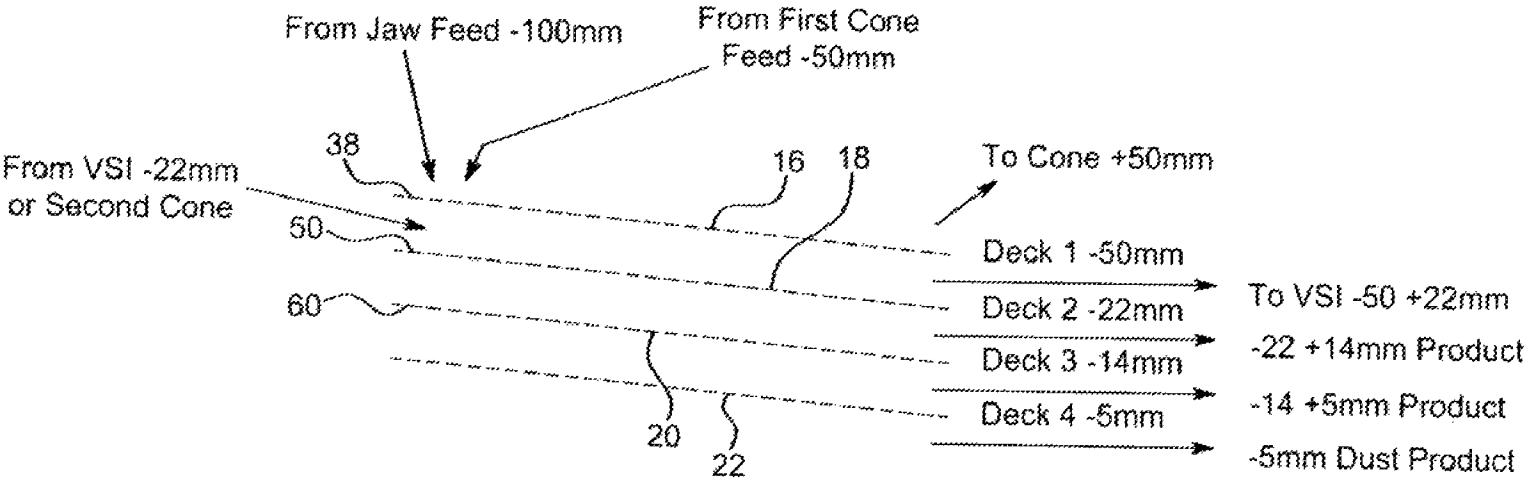
FIG. 24 shows a schematic layout of one example of a screen deck assembly of the apparatus of FIG. 23.

In FIGS. 23 and 24, a jaw crusher 96 carries out an initial crushing operation to generate a product with a maximum aggregate size of about 100 mm to 130 mm. This material is fed into the hopper or chute 42. In this example, the apparatus 10 has the top deck 16 configured to discharge material having an aggregate size greater than about 50 mm.

The cone crusher 88 is configured to generate a product with an aggregate size of about 50 mm, which is fed into the hopper 42 together with the material from the jaw crusher.

The first intermediate deck 18 thus receives material with an aggregate size no greater than about 50 mm. The first intermediate deck 18 is configured to discharge material with an aggregate size greater than about 22 mm. This material is then fed with the second side conveyor 64, via the first transfer conveyor 63, to the VSI or cone crusher 92.

The discharge end 48 of the secondary feed conveyor 46 communicates with the feed end of the first intermediate deck 18, with the chute 47 in a suitable position, so that the material circulates over the first intermediate deck 18 while material with an aggregate size of less than about 22 mm is received on the second intermediate deck 20. As before, the feeding of fines to the VSI crusher 92 is avoided.

The second intermediate deck 20 is configured to discharge material with an aggregate size greater than about 14 mm. It follows that the deck 20 discharges a final product with an aggregate size of between 14 mm and 22 mm. That product is fed, via the fourth transfer conveyor 69 onto the first radial conveyor 66 for stockpiling.

Thus, the bottom deck 22 receives material with aggregate size less than about 14 mm. The bottom deck 22 is configured to discharge material with an aggregate size greater than about 5 mm. It follows that the deck 22 discharges a final product with an aggregate size of between 5 mm and 14 mm. That product is fed, via the third transfer conveyor 67, onto the second radial conveyor 68 for stockpiling.

The fines conveyor 94 thus receives a dust product with an aggregate size less than about 5 mm for stockpiling.

In this example, the apparatus can therefore generate three finished products. It will be appreciated that the top sizing of the material from the second intermediate deck 20 is carried out while the material circulates over the first intermediate deck 18.

It will be appreciated that the apparatus 10 is capable of having a large number of different configurations to suit varying applications. One of the reasons for this is the ability to feed pre-screened material or product into a screen deck other than the top deck.

As is known, material fed onto an inclined screen deck moves downwardly, assisted by gravity and a vibratory mechanism arranged on the deck. As the material gets closer to a discharge end, aggregate of a predetermined size passes through the screen deck onto a lower or intermediate deck. For practical reasons, it is not possible for presently available decks to be longer than about 7 metres. Therefore, it is a known problem that a significant proportion of the desired aggregate does not pass through the top deck. Furthermore, material managing to pass through the top deck lands on the intermediate deck at a position in which the full length of the deck is not utilised. This is an accumulative problem with further decks receiving material at positions closer to their discharge ends. This is so much so that it has been pointless to provide more than three decks.

At present, attempts have been made to address this problem by feeding material, optionally via a further crusher, back on to the top deck. However, the capacity of the top deck is usually limited according to design parameters. For example, in a mobile apparatus, a size of the top deck must be limited in some way. It follows that circulating material back to the top deck necessarily limits the capacity of the top deck to screen freshly crushed material.

In addition, feeding all the material on to the top deck can result in underutilization of intermediate and lower decks. It can also result in contamination of stockpiles resulting from product carry over on the top deck. Such stockpiles can include aggregate having sizes not suitable for the intended use of the material in the stockpiles.

The ability to feed pre-screened material to intermediate decks can alleviate the problems associated with feeding all the material onto the top deck. For example, it reduces the amount of product required to be processed by the top deck. Also, it shortens the drop height the material or product has to fall before the product reaches the end of the relevant deck screen.

The apparatus 10 can be configured so that a fines screen is positioned on the first intermediate deck 18. The discharge end 48 of the secondary feed conveyor can then be arranged to feed into the second intermediate deck 20 or the lower deck 22 via the hydraulic feed chute 47. Thus, it will be possible to achieve a required relatively small aggregate size while not having to accommodate the fines. This is beneficial for VSI crushers, which do not operate optimally if fines are introduced.

As can be seen in FIG. 1, the cone crusher 88 and the VSI or cone crusher 92 are parallel to the screen box 24. This allows the screen box 24 to become the main processing unit with all conveyors and products coming from one machine and reducing the likelihood of contamination of material by utilizing substantially all the area around the machine.

As far as the inventors are aware, mobile screening apparatus are limited to having three decks. However, in order fully to make use of the ability to feed on to intermediate decks, it is desirable that more than three decks are provided. To date, this has not been possible because of the location of the motor and hydraulic power assembly in a central region of the chassis. A screen box with four or more decks would simply be too large to share the same region on the chassis. In any event, as mentioned above, the present feed mechanisms render more than three decks largely pointless.

The position of the motor and hydraulic pump assembly 30 on the front portion 28 of the support chassis 12 frees up space for one or more screen boxes. For example, this allows the screen box 24 with at least four decks to be positioned on the central portion 26. This also allows two screen boxes with the same or a different number of decks to be positioned on the chassis. For example, as mentioned above, the screen boxes can be positioned side-by-side, stacked, or back-to-back, depending on requirements.

It will readily be appreciated that the motor and hydraulic pump assembly 30 can be positioned on a rear portion of the chassis 12 to free up space for the screen box/es.

Figure 11:
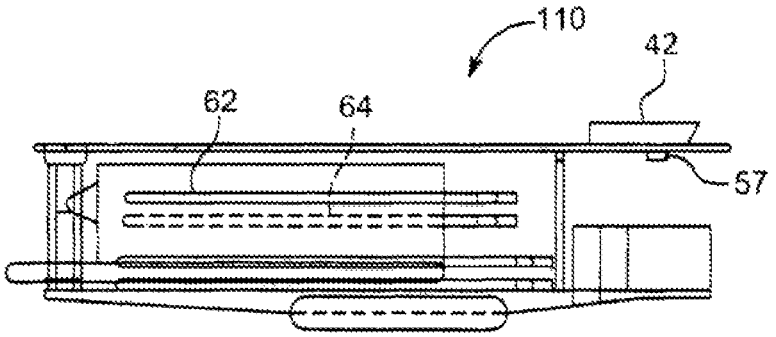
FIG. 11 shows a schematic side view of the mobile screening apparatus of FIG. 8 in a condition for transport.
Figure 12:
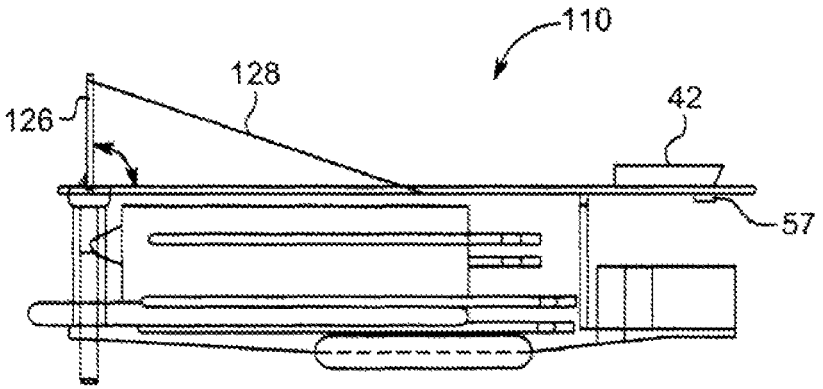
FIG. 12 shows a schematic side view of the mobile screening apparatus of FIG. 8 in a partially deployed condition.

Furthermore, the position of the assembly 30 can provide an apparatus with a four-deck screen box that is of a height that is less than presently available apparatus. As can be seen in FIG. 11, the height of the screen box 24 is about 2 m. It follows that the height of the apparatus 10 can be in the region of 3.5 m to 3.6 m, without the feed conveyors 36, 46, which is usually within regulatory height limits. However, the conveyors 36, 46 can remain mounted on the support chassis for areas, such as on site or in various jurisdictions, where there are less restrictions on height.

The apparatus 10 includes a hydraulic lifting or jacking arrangement positioned between a track sub frame of the chassis 12 and the screen box 24. The arrangement is operable to lift the screen box 24 to allow access to the screen decks or to the fines conveyor 94 for maintenance purposes. As described above, the fines conveyor 94 can be unlocked or disengaged from the screen box 24. This allows access to the screen decks and the fines conveyor.

The position of the assembly 30 means that this access is not impeded. Furthermore, the hydraulic arrangement can be used to manipulate both the screen box and the fines conveyor for stowed or operational use without obstruction by the assembly 30.

Furthermore, in presently used mobile screening apparatus, the motor and hydraulic pump assemblies are positioned transversely on the chassis. This is necessary to allow the mounting of a feed bin on the front of the chassis. In this invention, a feed bin has been replaced with the primary feed conveyor 36 and the secondary feed conveyor 46 feeding from the rear of the screen box 24. Also, the motor and hydraulic pump assembly 30 is positioned lengthwise along the front portion 28 of the chassis 12. This frees up space for the radial conveyors 66, 68, allowing them to stockpile material away from the side conveyors 62, 64 and from each other so that the stockpiles do not contaminate each other.

Thus, by not using a feed bin and introducing the feed conveyors 36, 46 that extend radially, it has been possible for the screen box 24 to be positioned further forward on the chassis 12 as would usually be the case. This allows the addition of a further product conveyor, if desired.

The inventors have found that the resultant ability to position the discharge conveyors has produced 25% to 30% more ground space for stockpiling than with existing apparatus and with a reduced risk of cross contamination.

It will be appreciated that the position of the assembly 30 on the front portion 28 of the chassis 12 facilitates access to the assembly for maintenance purposes. As is clear from the drawings, access is possible from three sides of the assembly 30. At present, access can be difficult since it can be obstructed by the screen box 24. It follows that the position of the assembly can reduce maintenance downtime when compared with present apparatus.

The apparatus 10 can readily be configured as a semi-trailer, instead of having the track assemblies 34. In that configuration, the assembly 30 is supported on a goose neck that is wide enough to support the assembly 30. In this configuration, the chassis 12 can be longer and so able to incorporate wider and longer screens. Support hydraulic legs can be provided for stability if necessary. This configuration could incorporate a large variety of screen decks. It could also incorporate a large, track mounted feed bin that would accommodate at least two loader buckets equivalent to those supplied by Caterpillar® and known as Cat 998 loader buckets.

The provision of up to four decks and the secondary feed conveyor allows the use of two intermediate crushers. As can be seen from the examples above, the apparatus 10 is capable of generating three different products.

It will readily be appreciated that the apparatus 10 can be used without any crushers. In that case it will be possible to generate five finished products. Alternatively, just one crusher can be used so that four finished products are generated. Furthermore, more than two crushers can also be used with the apparatus 10. It follows that a large number of various screening configurations are possible with the apparatus. This description should not be regarded as limiting the number of configurations in any way.

The apparatus 10 can be used to screen any of a number of different materials. The above description should not be regarded as limiting the types of material that can be used with the apparatus 10. Thus, the apparatus 10 can be used to screen any material which currently requires screening within the field of the invention.

In FIGS. 8 to 16, reference numeral 110 generally indicates an example of a screening apparatus. With reference to FIGS. 1 to 8 and 17 to 24, like reference numerals refer to like parts, unless otherwise specified.

The apparatus 110 is suited for use with a horizontally operable screen box 24.

In FIGS. 8, 9, 11, 13 and 14 the screening apparatus 110 is shown with the feed conveyors 36, 46, the side conveyors 62, 64 and the radial conveyors 66, 68 folded against or towards the screen box 24 for storage. In that condition, the apparatus 110 can move or be moved to a new location.

The discharge end 40 of the primary feed conveyor 36 is mounted on a support structure 118 that itself is mounted on the support chassis 12. Likewise, the discharge end 48 of the secondary feed conveyor 46 is mounted on a support structure 120 that itself is mounted on the support chassis 12.

Figure 14:
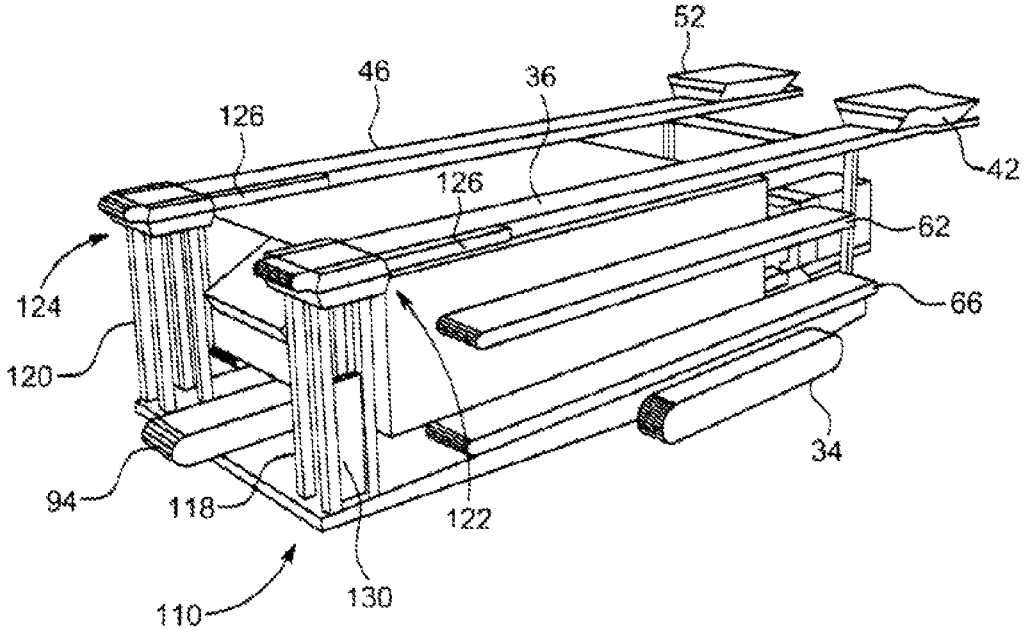
FIG. 14 shows another schematic three-dimensional view of the screening apparatus of FIG. 13, in a condition for transport.
Figure 15:
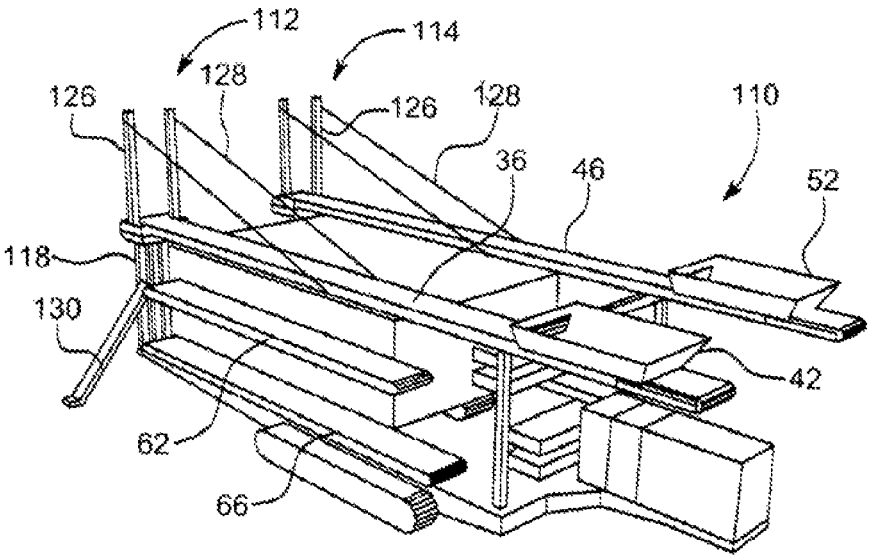
FIG. 15 shows a schematic three-dimensional view of the screening apparatus of FIG. 13 in a partially deployed condition.

The discharge ends 40, 48 are mounted on the support structures 118, 120 with slew ring arrangements or assemblies, indicated at 122, 124 (FIG. 14). Thus, the conveyors 36 and 46 can pivot towards and away from the screen box 24 in a generally horizontal plane. This also allows the conveyors to be pivoted into their stowed and operational conditions.

The slew ring assemblies 122, 124 can be powered or driven, for example, hydraulically.

The screening apparatus 110 includes hanger arrangements 112, 114 to support the primary and secondary feed conveyors 36, 46 in their operative conditions.

Each hanger arrangement 112, 114 includes a pair of support posts 126 mounted on each slew ring assembly 122, 124. A support chain, rope or cable 128 is connected between a free end of each post 126 and its associated conveyor at a point intermediate ends of the conveyer, as can be seen in FIGS. 10, 12, 15 and 16.

The hanger arrangements 112, 114 are used in combination with the support assembly 56 incorporating the wheels 57.

Figure 13:
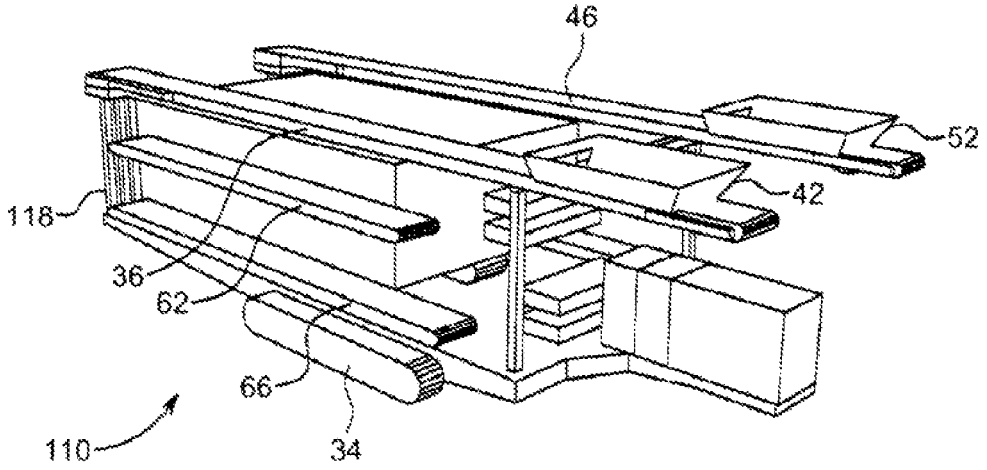
FIG. 13 shows a schematic three-dimensional view of an example of a screening apparatus, in a condition for transport, with conveyors, support beams and jacking legs stowed for transport.
Figure 16:
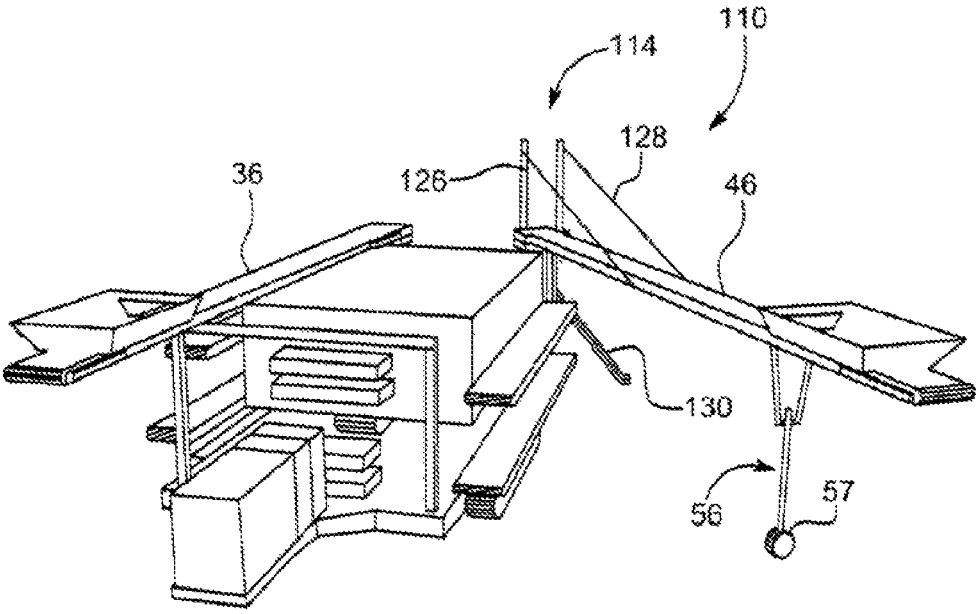
FIG. 16 shows a schematic three-dimensional view of the screening apparatus of FIG. 13 in the partially deployed condition with one feed conveyor partially deployed.

The support posts 126 are capable of being folded down when not in use, as shown in FIGS. 13, 14 and 16.

The screening apparatus 110 includes a support beam 130 that can fold out from each support structure 118, 120 to engage the ground and stabilise the apparatus 110 in use.

Figure 25:
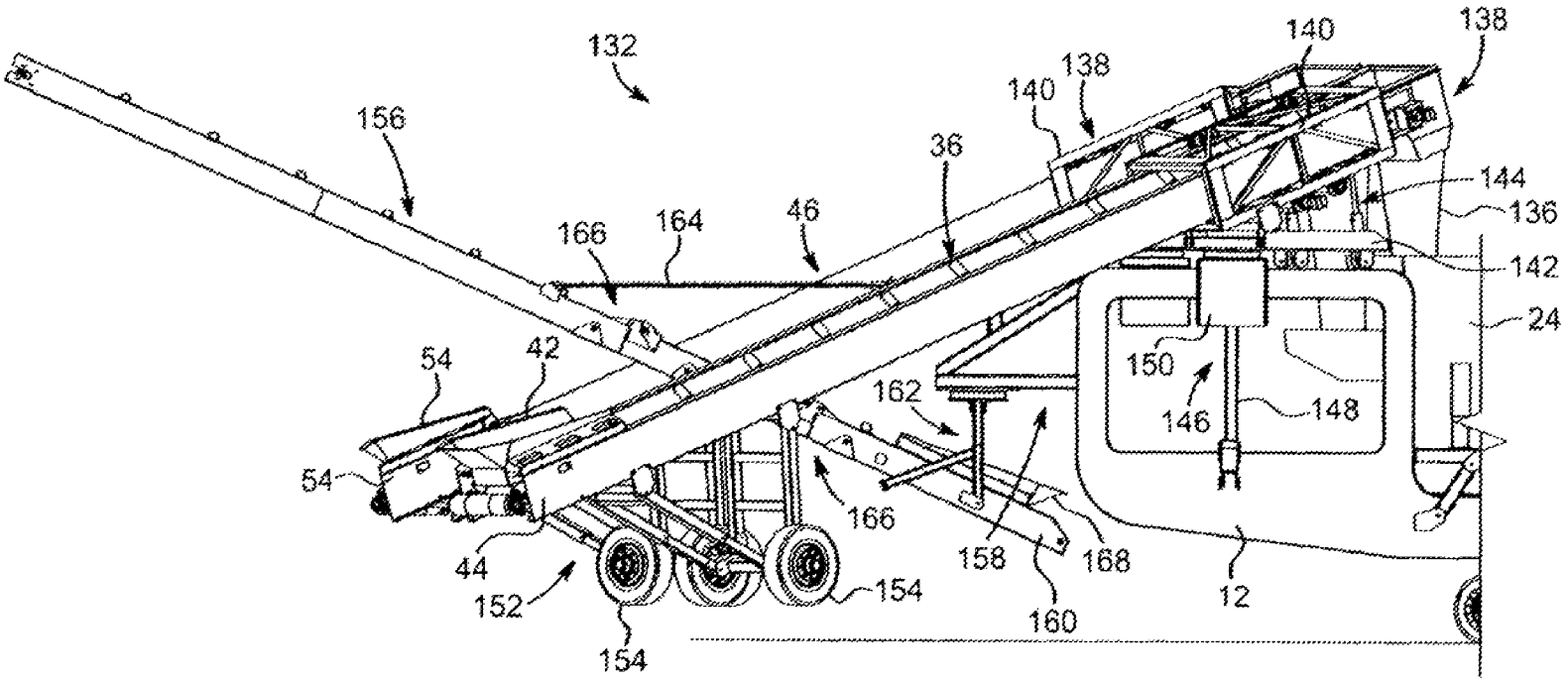
FIG. 25 shows a feed end of another example of the apparatus.

In FIG. 25 there is shown a feed end of another example of a screening apparatus 132. With reference to the preceding drawings, like reference numerals refer to like parts, unless otherwise specified.

The screening apparatus 132 is suited for use with a horizontally operable screen box 24. Furthermore, the various components of the apparatus 132 can be interchanged with the components of the apparatus described above.

The apparatus 132 includes a mounting assembly 138 for mounting each conveyor 36, 46 to the support chassis 12 at a position above the screen box 24. The mounting assembly 138 includes a box or winch frame 140 through which the conveyor 36, 46 can move when winched, for example. The winch frame 140 is pivotally mounted on a support assembly 146 that extends from the support chassis 12 so that the conveyor 36, 46 can be pivoted with respect to the screen box 24. To that end, the winch frame 140 is mounted on a base structure 142 that itself is pivotal with respect to the support assembly 142. The support assembly 142 includes an arm 148 that is attached to the chassis 12 at one end. A carrier 150 is attached to an opposite end of the arm 148.

The base structure 142 and the carrier 150 can incorporate a slew ring assembly or the like to permit the respective pivotal movement.

The winch frame 140 is pivotal, in a vertical plane, with respect to the base structure 142.

A hydraulic ram arrangement 144 is arranged between the winch frame 142 and the base structure 142 to facilitate tilting of the winch frame 142 and thus the conveyor 36, 46 with respect to the base structure 142.

It is to be understood that each conveyer 36, 46 need not necessarily include the winch frame 140. Instead, as described above, the conveyors can simply be pivoted into their stowed positions in a generally horizontal plane.

A discharge chute 136 is also arranged at each of the ends 40, 48 to feed material or aggregate to be screened onto the top screen deck 16.

An undercarriage 152 depends from each conveyor 36, 46. A pair of wheels 154 is arranged on each undercarriage 152. The undercarriage 152 and the wheels 154 are configured to allow the feed ends 44, 54 to be supported while being moved towards and away from the screen box 24. The undercarriage 152 is also configured to be folded up against the conveyor 36, 46 when the conveyor 36, 46 is stowed for transport.

The wheels 154 are capable of pivotal movement about a vertical axis to accommodate pivoting or swivelling of the conveyor 36, 46 with respect to the screen box 24. The wheels 154 can also be driven and steered.

Also shown in FIG. 25 is a fines discharge conveyor 156. The fines conveyor 156 is mounted on the chassis 12 via a support structure 158 to be in communication with the fines conveyor 94 described above. A feed end 160 is suspended from the support structure 158 with a hanger assembly 162. The conveyor 156 is also tethered to the support structure 158 with a chain or rope 164 connected to the conveyor 156 at a position intermediate its ends.

The fines conveyor 156 includes a pair of folding hinges 166 to permit the conveyor 156 to be folded up against the chassis 12 when stowed for transport.

A feed hopper 168 is arranged on the feed end 160 to be positioned beneath a discharge end of the fines conveyor 94.

Figure 26:
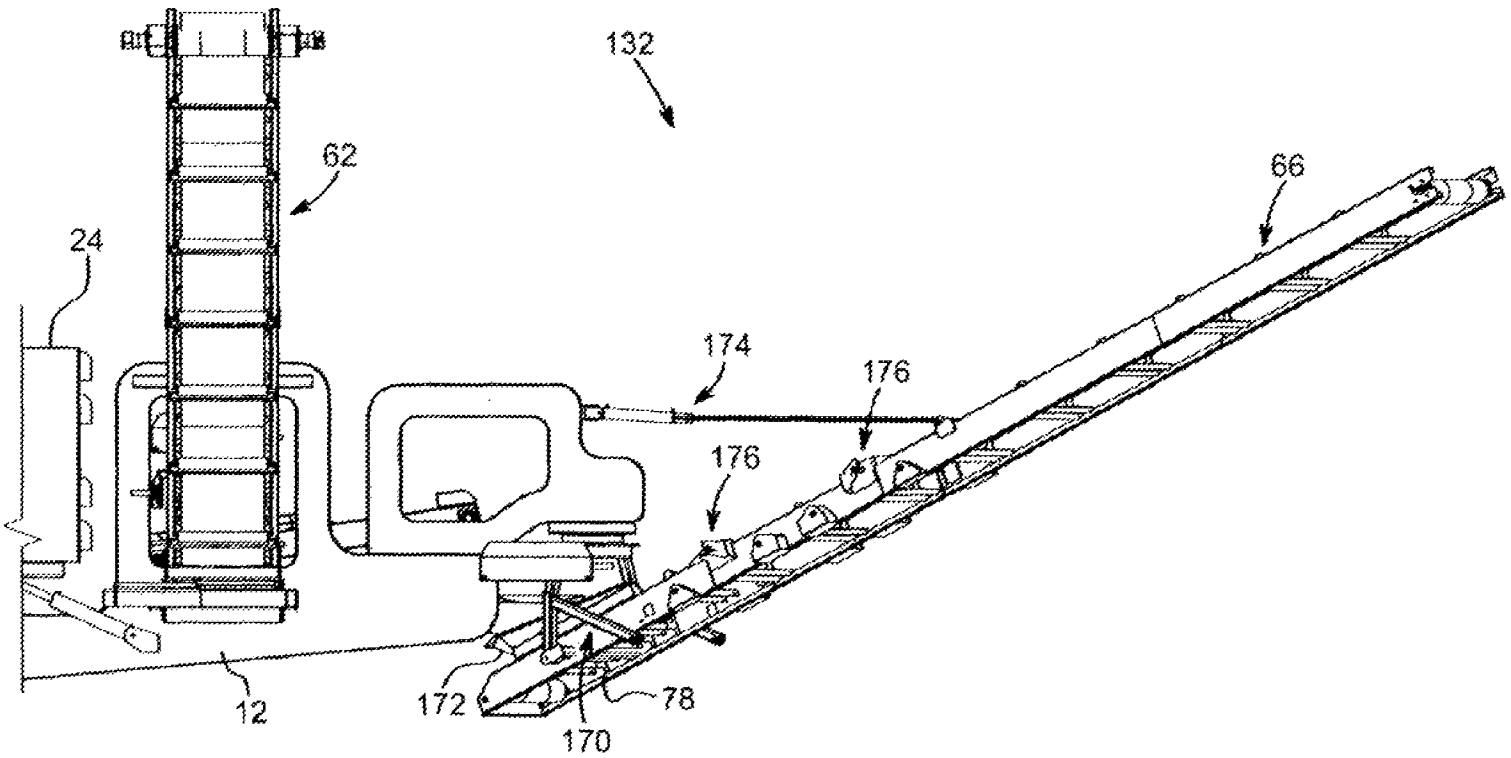
FIG. 26 shows a discharge end of the apparatus of FIG. 25.

In FIG. 26, there is shown a discharge end of the apparatus 132. This drawing shows the side conveyor 62 and the radial conveyor 66.

The feed end 78 of the radial conveyor 66 is suspended from the chassis 12 with a hanger assembly 170 and has a feed hopper 172 to receive product. The radial conveyor 66 is also tethered to the chassis 12 with a tethering assembly 174, between the chassis 12 and a position intermediate ends of the conveyor 66. The radial conveyor 68 is also mounted to the chassis 12 in this manner.

The conveyor 66 includes a pair of folding hinges 176 to permit the conveyor 66 to be folded up against the chassis 12 for stowage and transport.

Figure 27:
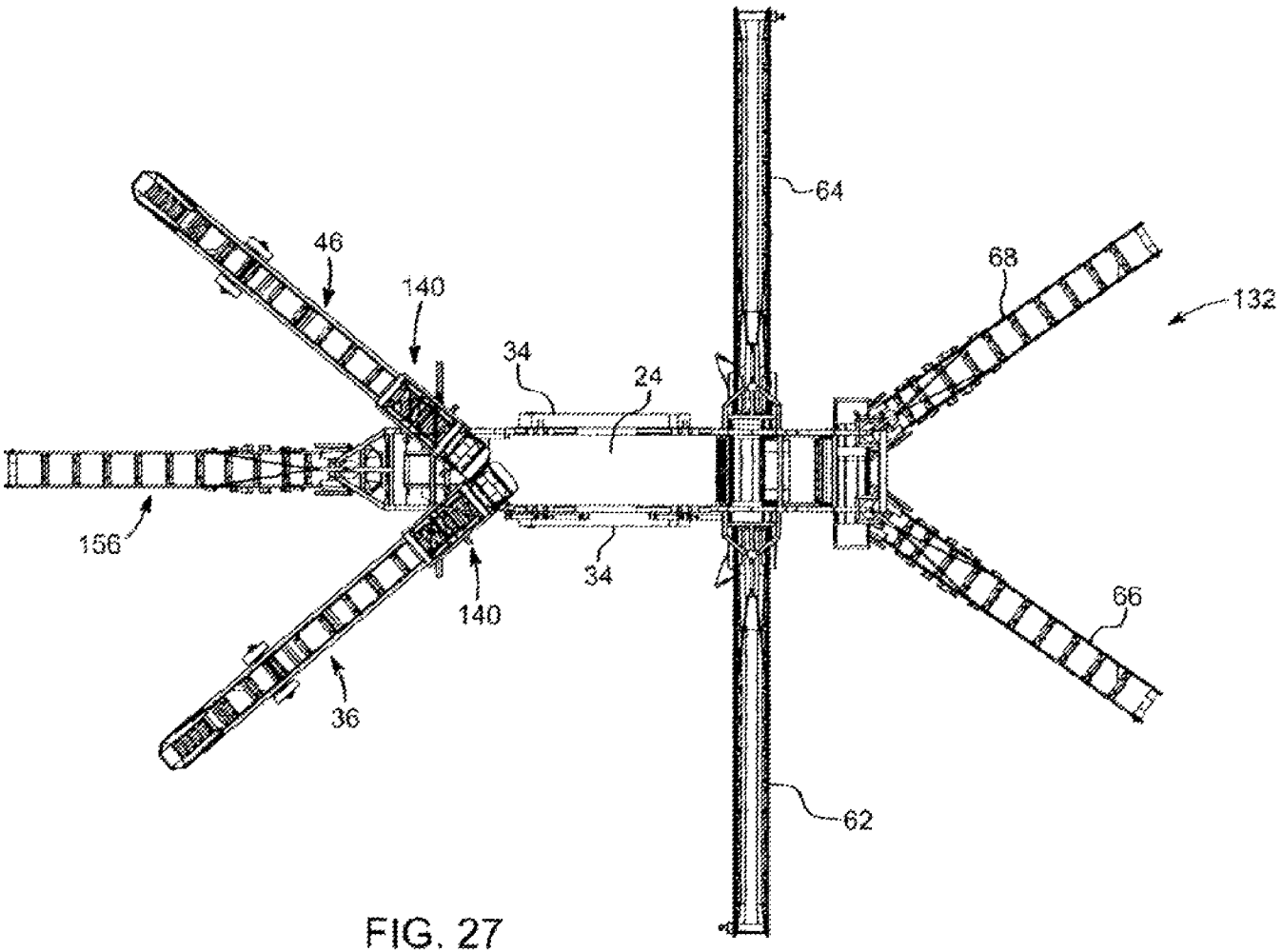
FIG. 27 shows a layout of conveyors and the apparatus referred to in FIG. 25, in operation.

FIG. 27 shows the apparatus 132 in an operative condition. As can be seen, the winch frames 140 and thus the feed conveyors 36, 46 are pivoted outwardly away from each other to facilitate feeding of material onto the conveyors 36, 46 without interference. The side conveyors 62, 64 are aligned and extend away from the screen box 24 on each side of the screen box 24. The radial conveyors 66, 68 extend from the screen box 24 at respective angles with respect to a longitudinal axis of the screen box 24.

Figure 28:
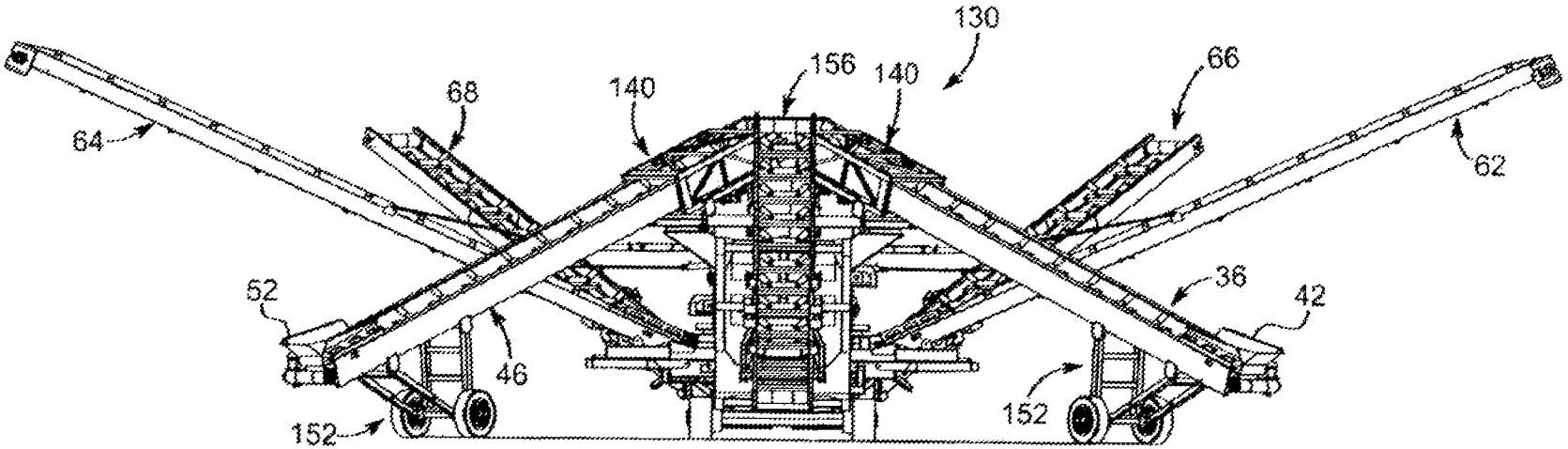
FIG. 28 shows a feed end of the apparatus with conveyors in a working condition.

FIG. 28 shows a feed end of the apparatus 132, in an operative condition.

Figure 29:
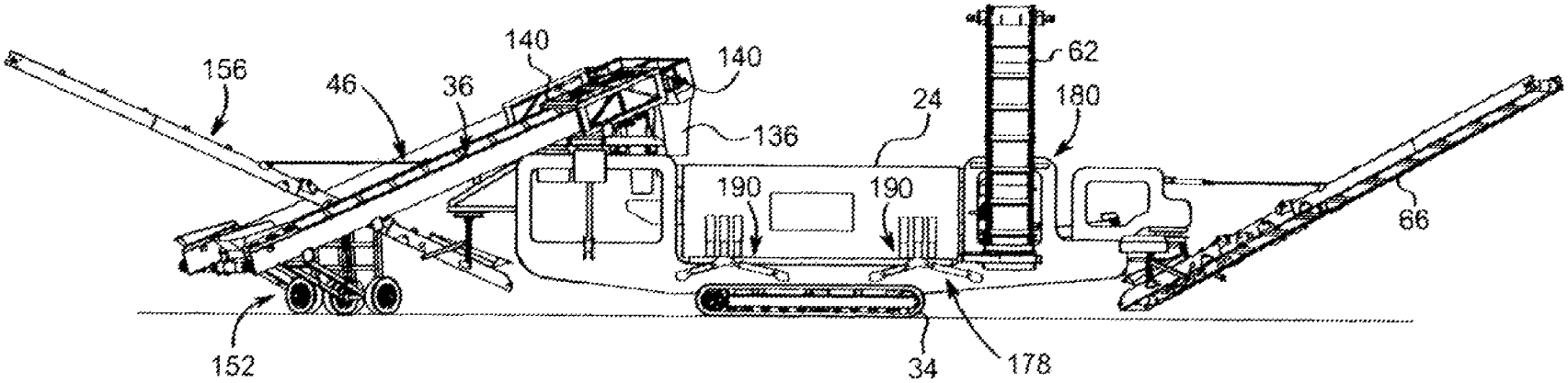
FIG. 29 shows a side view of the apparatus and conveyors in a working condition.
Figure 30:
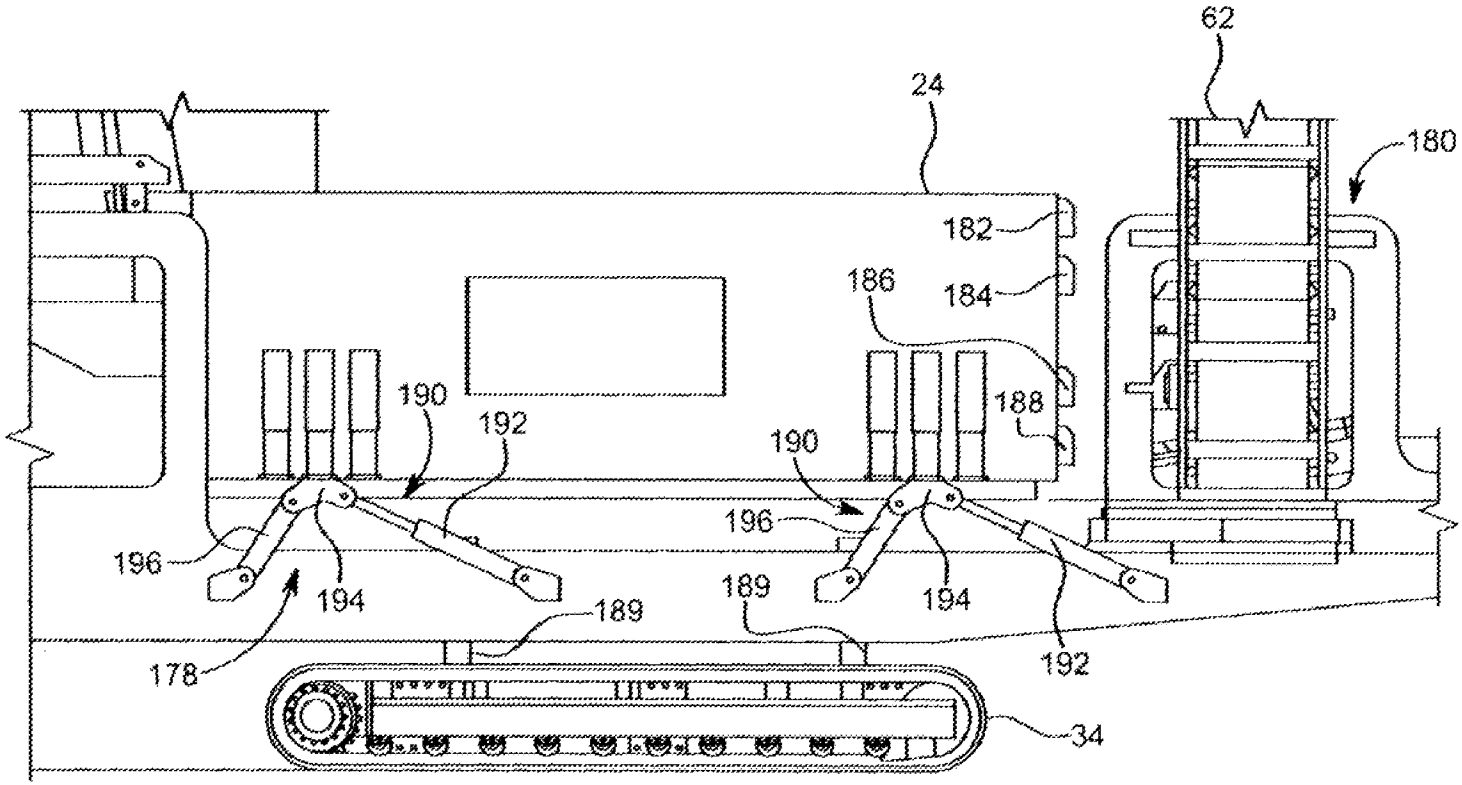
FIG. 30 shows a further side view showing a lifting assembly of the apparatus.

FIG. 29 shows a side view of the apparatus 132, in an operative condition. FIG. 30 is an enlarged view to indicate a displacement mechanism 178 that is used to lift the screen box 24 off the support chassis 12.

Also, partially shown in FIG. 30 is a transfer conveyor assembly 180 for transferring product from the screen box 24 to the side and radial conveyors 62 to 68.

Discharge ends 182, 184, 186 and 188 of the top, first intermediate, second intermediate and bottom decks 16, 18, 20 and 22 are also shown.

The displacement mechanism 178 includes a pair of jacking assemblies 190 on each side of the screen box 24 and support chassis 24. Each assembly 190 includes a hydraulic ram 192 pivotally mounted to the support chassis at one end and to the screen box 24 at another end with a suitable bracket 194. An arm 196 is pivotally mounted to the bracket 194 at one end and to the chassis 24 at an opposite end. The relative positions of the rams 192 and their associated arms 196 is such that actuation of the rams results in the screen box 24 being lifted off the support chassis 12 and being driven upwardly and away from the discharge end. In that condition, shown in FIG. 30, the ends 182, 184, 186 and 188 are spaced from the transfer conveyor assembly 180 to allow access. In this way, access to the bottom of screen box and the fines conveyor is provided.

Also shown in FIG. 30 is a jacking mechanism in the form of two or more hydraulic ram assemblies, indicated at 189, that are engaged with the track assemblies 34 and the chassis 14 so that, when actuated, they can lift the chassis 14 from the track assemblies 34 to facilitate inspection, maintenance and repair. In use, the ram assemblies 189 are actuated to lift the chassis 14. Once lifted, the apparatus can be driven on to a transporter and then lowered again prior to transport.

Figure 31:
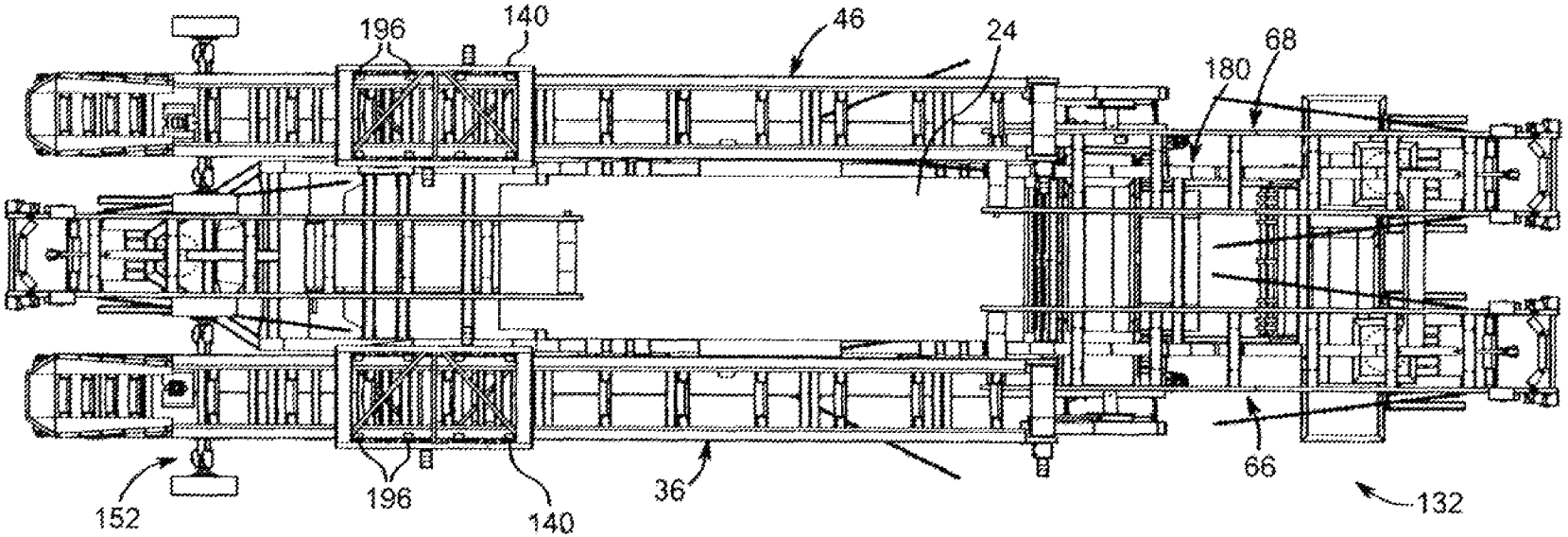
FIG. 31 shows a plan view of the apparatus, in a mobile condition.
Figure 32:
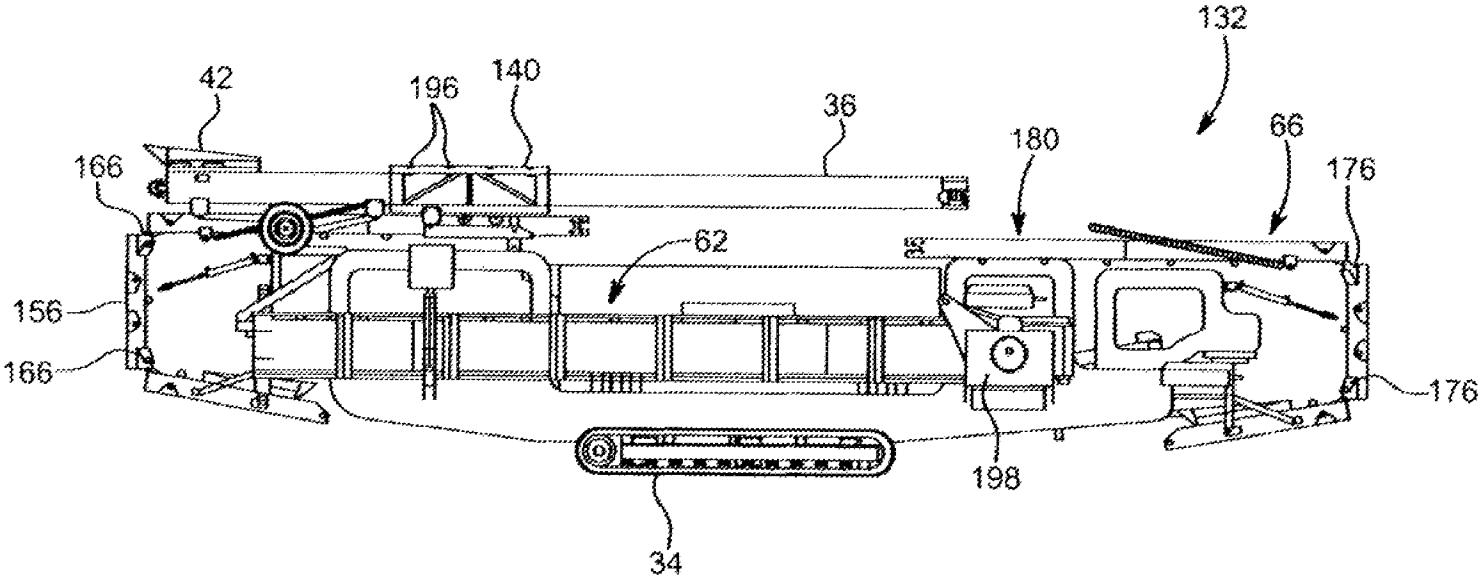
FIG. 32 shows a side view of the apparatus, in a mobile condition.

FIGS. 31 and 32 show top and side views of the apparatus 132 with the conveyors stowed for transport.

The winch frames 140 incorporate rollers or runners 196 that engage the conveyors 36 to 46 to facilitate displacement of the conveyors 36, 46 with respect to the frames 140.

In this condition, the undercarriages 152 are folded up and the feed conveyors 36, 46 are displaced through the winch frames 140 towards a discharge end. The feed conveyors 36, 46 are pivoted inwardly to lie generally parallel to the longitudinal axis of the feed box 24 and on each side of the feed box 24.

The side conveyors 62, 64 are each pivotally mounted on a base platform 198 so that they can be pivoted from the operative positions into inoperative positions to be generally parallel to the longitudinal axis of the screen box 24. The platform 198 is itself pivotally mounted on the chassis 12 to be pivotal into a position in which the conveyors 62, 64 can be tilted towards the screen box 24 to finally stow the conveyors 62, 64.

The manner in which the fines conveyor 156 and each radial conveyor 66, 68 is folded for stowage is shown in FIG. 32.

Figure 33:
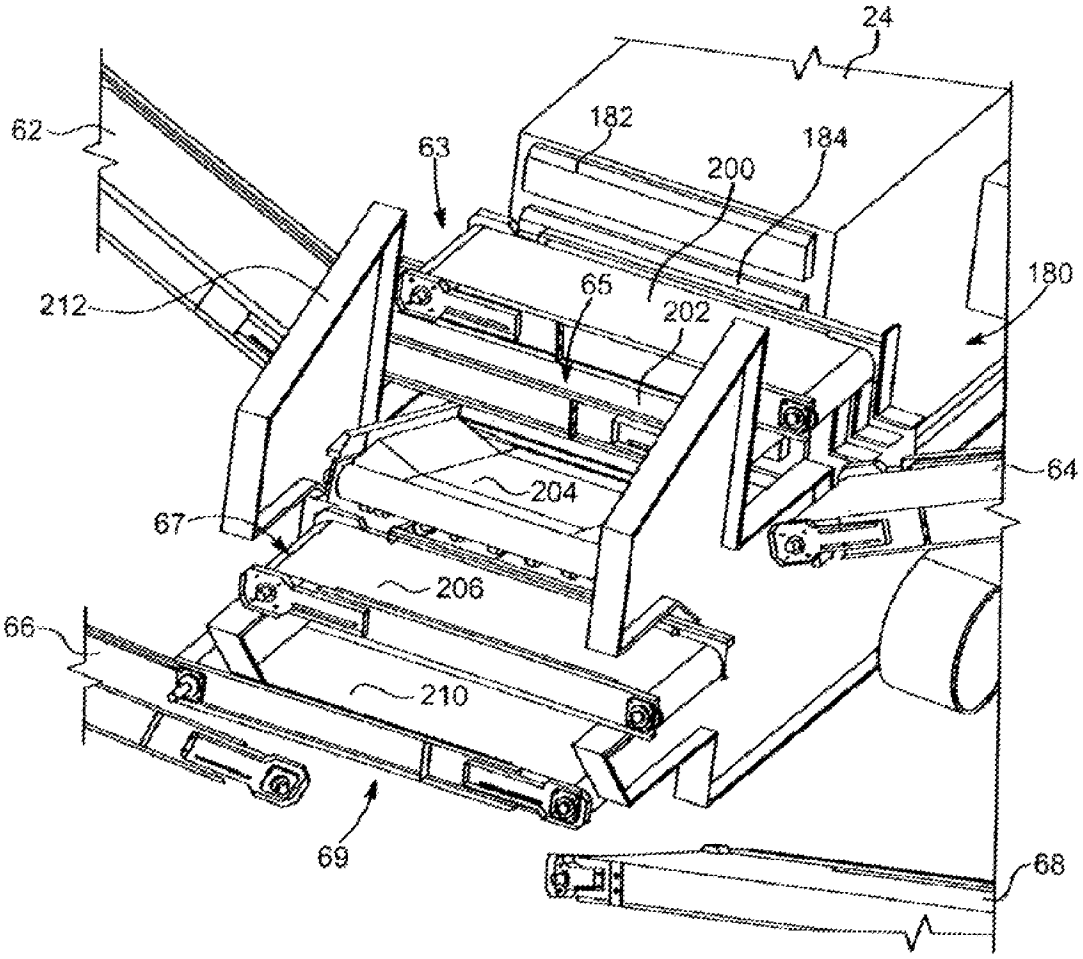
FIG. 33 shows a discharge end of the apparatus, in a working condition.

FIG. 33 shows the transfer conveyor assembly 180 in operation.

As can be seen, the first transfer conveyor 63 receives product from the top deck 16. The conveyor 63 is transversely oriented with respect to a feed direction from the top deck 16 and a belt 200 of the conveyor 63 is driven in a clockwise direction to deposit or discharge product onto the second side conveyor 64.

It is to be appreciated that the direction of rotation of the first transfer conveyor 63 can be reversed, if necessary, to accommodate various arrangements of intermediate crushers or if it is necessary to alter a position of a product stockpile.

The second transfer conveyor 65 receives product from the first intermediate deck 18. The conveyor 63 is transversely oriented with respect to a feed direction from the first intermediate deck 18 and a belt 202 of the conveyor 65 is driven in an anti-clockwise direction to deposit or discharge product onto the first side conveyor 62. Again, a direction of rotation of the second transfer conveyor 65 can be reversed if necessary and for the reasons provided in respect of the first transfer conveyor 63.

The assembly 180 includes an upper intermediate conveyor 204 that is generally aligned with the second intermediate deck 20 to receive product from the second intermediate deck 20. The upper intermediate conveyor 204 is configured to convey product and to discharge that product onto the third transfer conveyor 67. It is to be understood that a chute arrangement can be used instead of the intermediate conveyor 204. In this regard, the requirement is to convey the product out from underneath the first and second transfer conveyors 63, 65.

The third transfer conveyor 67 is positioned away from the conveyor 65 in a screen box discharge direction. The upper intermediate conveyor 204 is thus configured to convey product from the second intermediate deck 20 underneath the transfer conveyors 63, 65 and onto the third transfer conveyor 67.

The conveyor 67 is transversely oriented with respect to a feed direction from the second intermediate deck and a belt 206 is driven in a clockwise direction to deposit product onto the second radial conveyor 68. A direction of rotation of the third transfer conveyor 67 can be reversed for the reasons given above in respect of the other transfer conveyors.

The assembly 180 includes a lower intermediate conveyor (not seen in this drawing) that is generally aligned with respect to the bottom deck 22 to receive product. The lower intermediate conveyor is configured to convey product from the bottom deck 22 to the fourth transfer conveyor 69.

The conveyor 69 is transversely oriented with respect to a feed direction from the lower intermediate conveyor 208 and a belt 210 is driven in an anticlockwise direction to deposit product onto the first radial conveyor 66. A direction of rotation of the fourth transfer conveyor 69 can be reversed for the reasons given above in respect of the other transfer conveyors.

The chassis 12 incorporates a wall structure 212 that is shaped and configured to provide a support for the intermediate conveyors and the third and fourth transfer conveyors.

Figure 34:
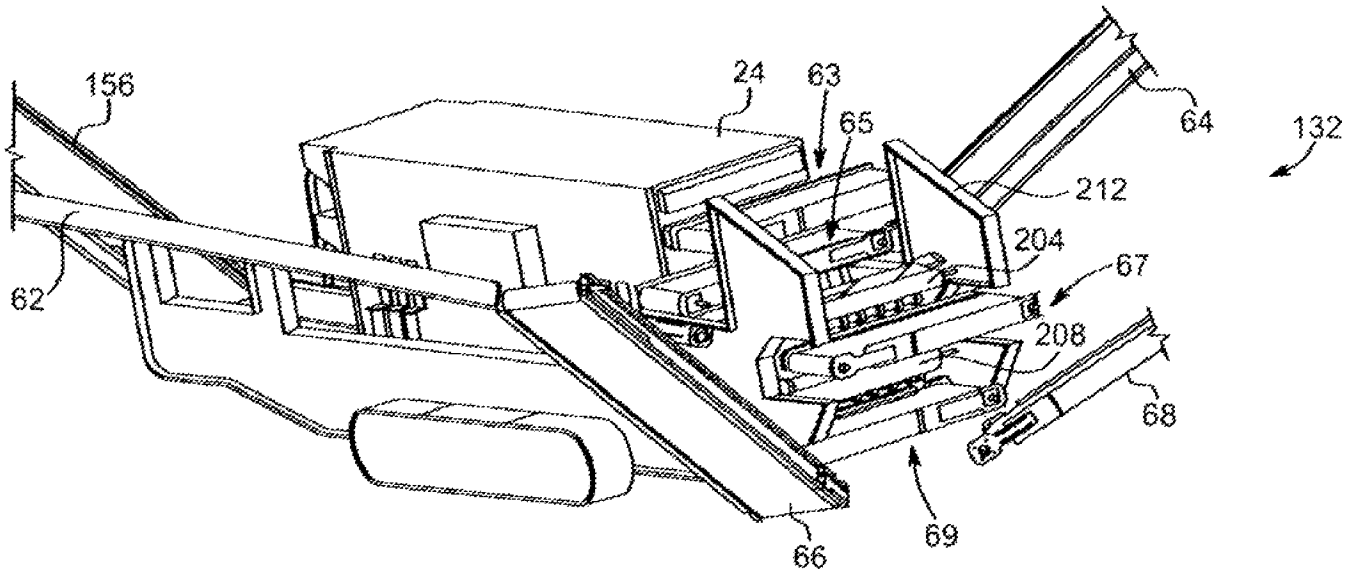
FIG. 34 shows a further view of the discharge end of the apparatus, in a working condition.

FIG. 34 shows a schematic three-dimensional view of the apparatus 132 from a discharge side or end. In this view, the lower intermediate conveyor is indicated with reference numeral 208.

Figure 35:
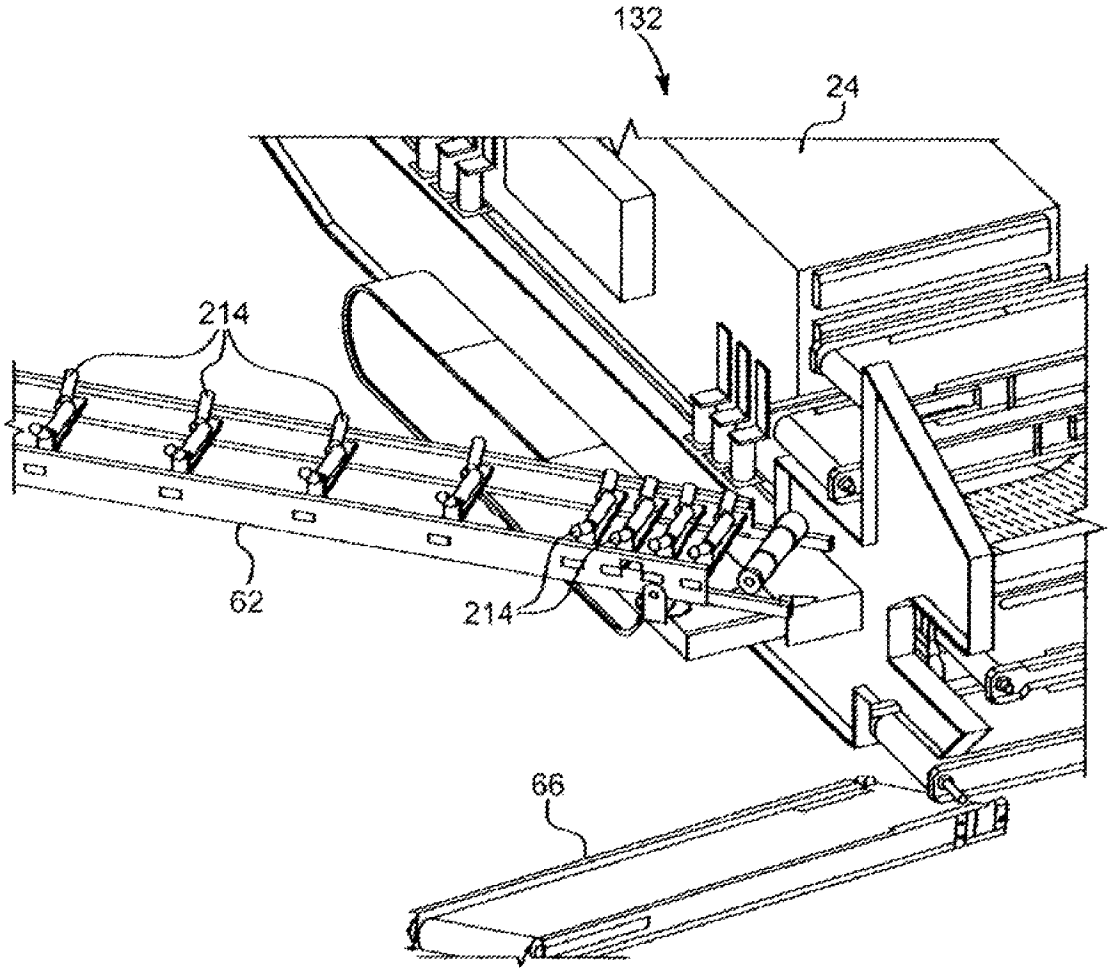
FIG. 35 shows a further view of the discharge end of the apparatus in a working condition.

FIG. 35 shows a further schematic three-dimensional view of the apparatus 132 from the discharge side or end. In this view, a structure of the first side conveyor 62 is shown. As can be seen, the conveyor 62 has a series of rollers 214 on which a belt of the conveyor 62 is driven. This structure is common to all the conveyors of the apparatus 132.

Figure 36:
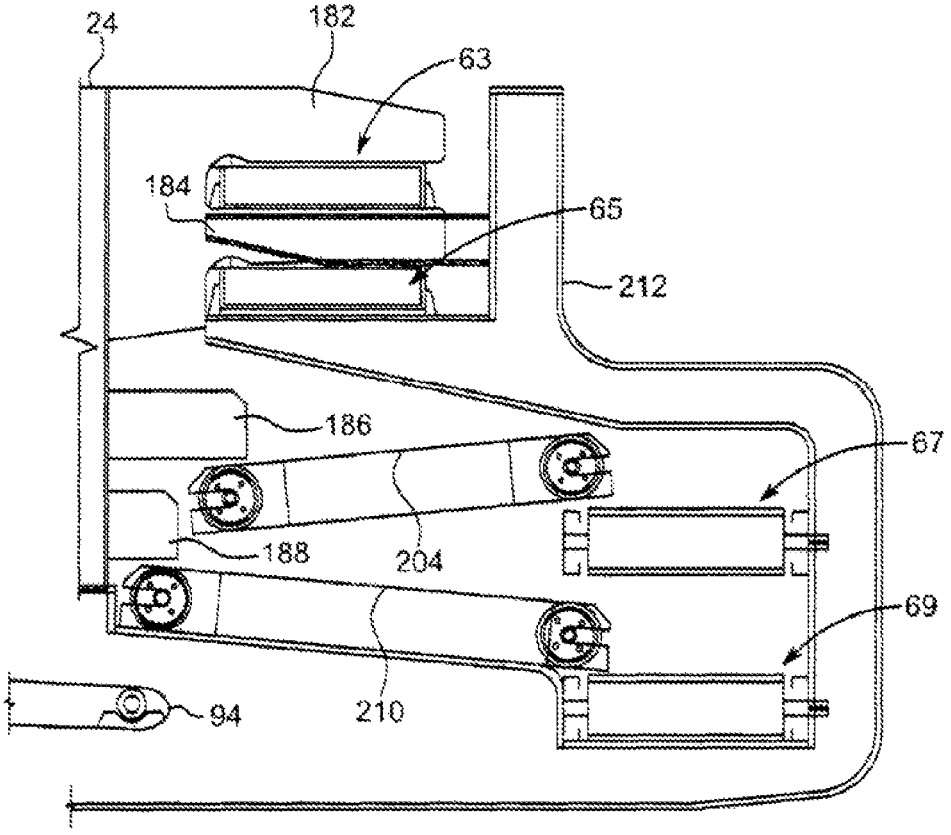
FIG. 36 shows a schematic sectioned side view of a transfer conveyor arrangement of the apparatus.

FIG. 36 shows a schematic side section view of the transfer conveyor assembly 180. In this drawing, the relative orientations of the transfer conveyors and intermediate conveyors can be seen.

In particular, the upper intermediate conveyor 204 is angled upwardly towards its discharge end. In contrast, the lower intermediate conveyor 208 is angled downwardly towards its discharge end. This allows the third and fourth transfer conveyors 67, 69 to be positioned one above the other and in general vertical alignment. The manner in which the conveyors 67, 69 are mounted in the wall structure 212 can also be seen.

The fines conveyor 94, positioned beneath the screen box 24, can also be seen. The fines conveyor 94 rotates in an anticlockwise direction to feed fines onto the conveyor 156, described in the previous drawings.

FIGS. 37 to 40 show schematic three-dimensional views of the apparatus 132. These drawings show how one of the side conveyors, more particularly the first side conveyor 62 is stowed for transport. However, this form of stowage is also applicable for the other conveyors, particularly the second side conveyor 64.

Figure 38:
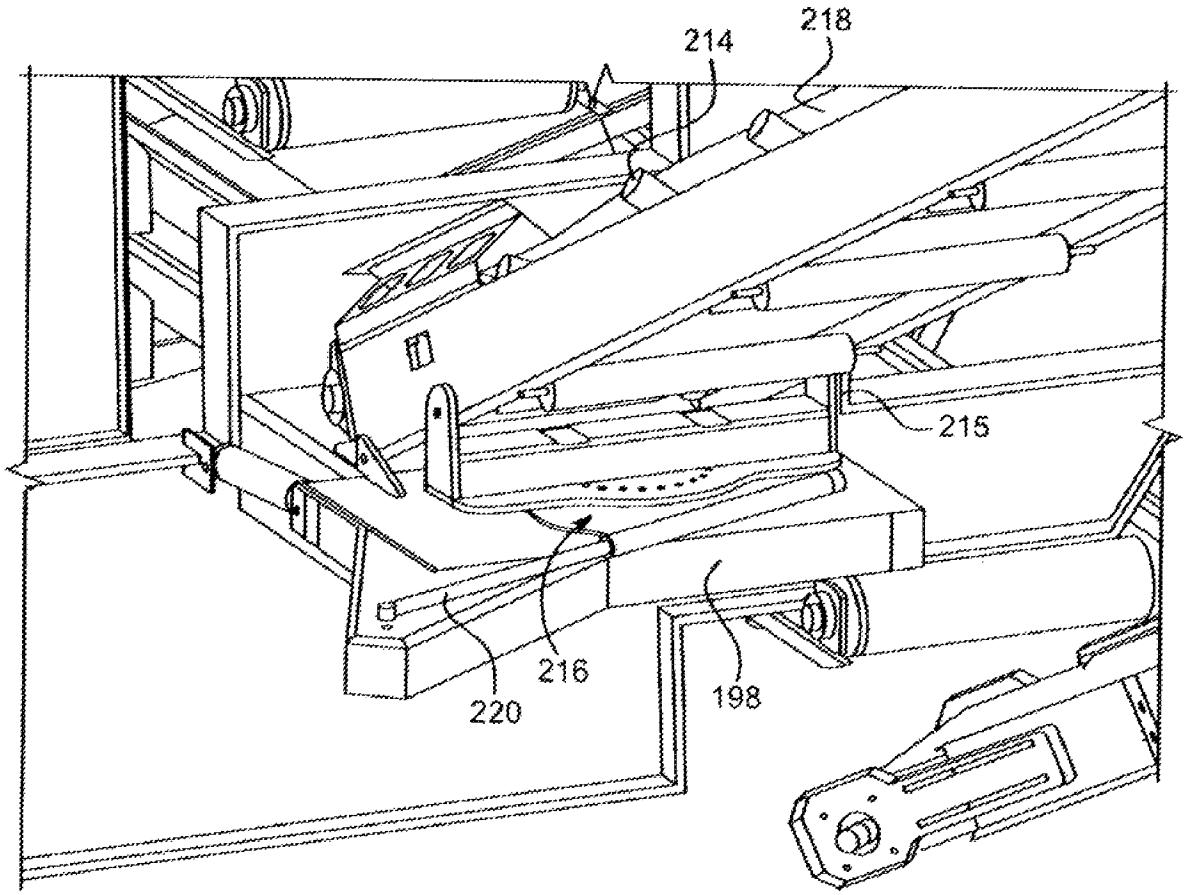
FIG. 38 shows a detail view of a manner in which a discharge conveyor is mounted to a screen box of the apparatus.
Figure 39:
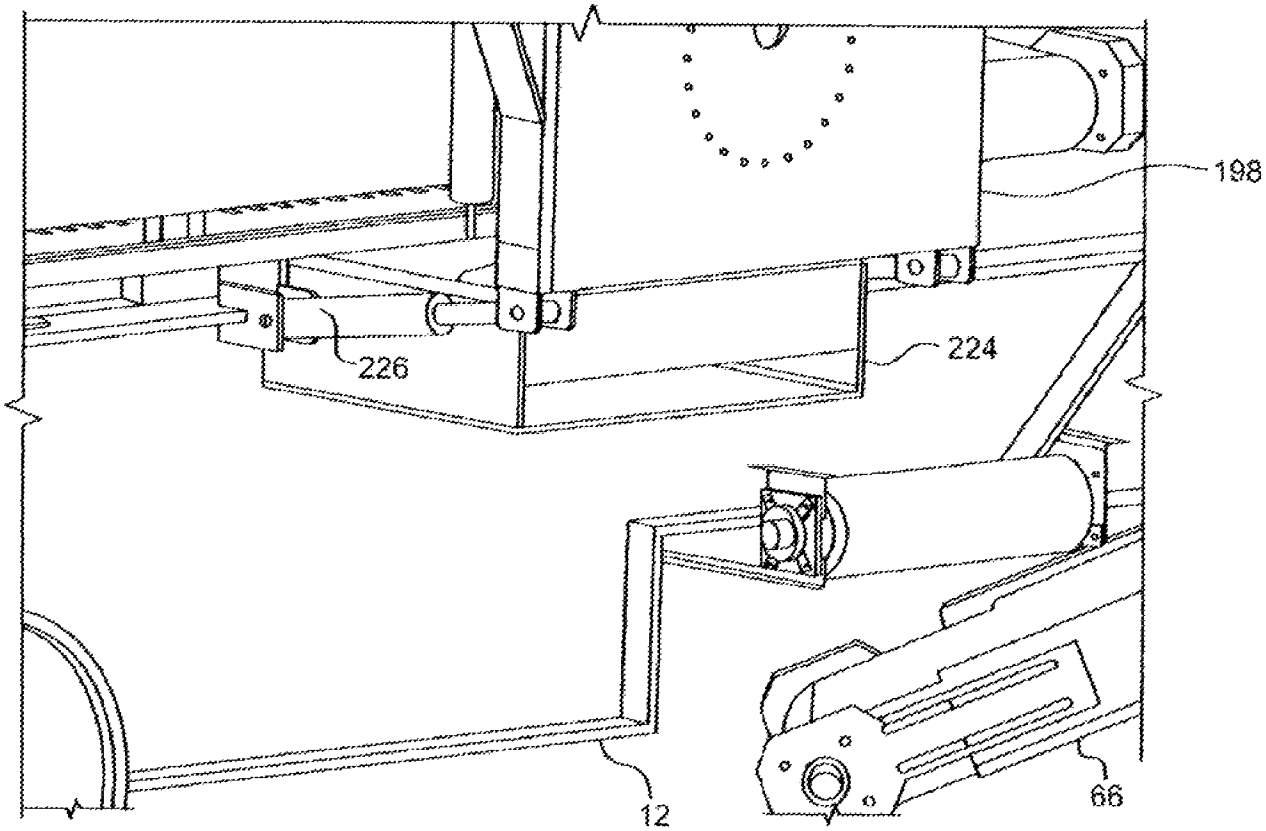
FIG. 39 shows a detailed view of a manner in which the discharge conveyor is tilted for stowing.
Figure 40:
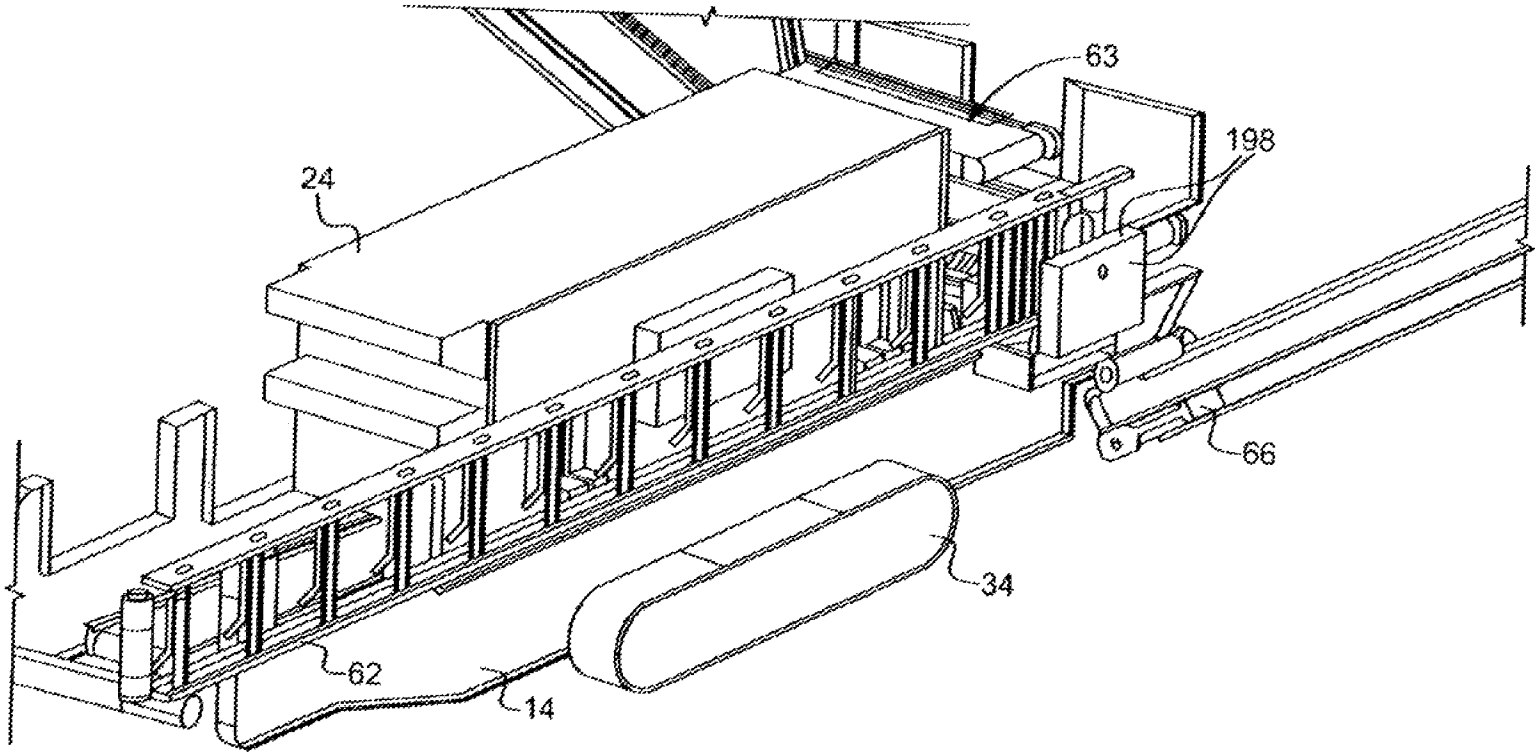
FIG. 40 shows a side view of the apparatus with a discharge conveyor in a stowed condition.

In FIG. 38, the base platform 198 can be seen more clearly. A carriage 215 is rotatably mounted on the base platform 198. This can be achieved with a slew ring arrangement indicated at 216. Side rails 218 are pivotally mounted on the carriage 214 so that the side conveyor 62 can be pivoted upwardly and downwardly. The base platform 198 is pivoted or hinged with respect to the chassis 12 so that the base platform 198 can be pivoted upwardly towards the chassis 12.

More particularly, the platform 198 is pivotally mounted on a ledge or support 224 (FIG. 39) that extends from the chassis 12. A pair of hydraulic rams 226 is interposed between the chassis 12 and the base platform 198 so that operation of the rams 226 can result in the base platform 198 pivoting upwardly towards the chassis 12.

Figure 37:
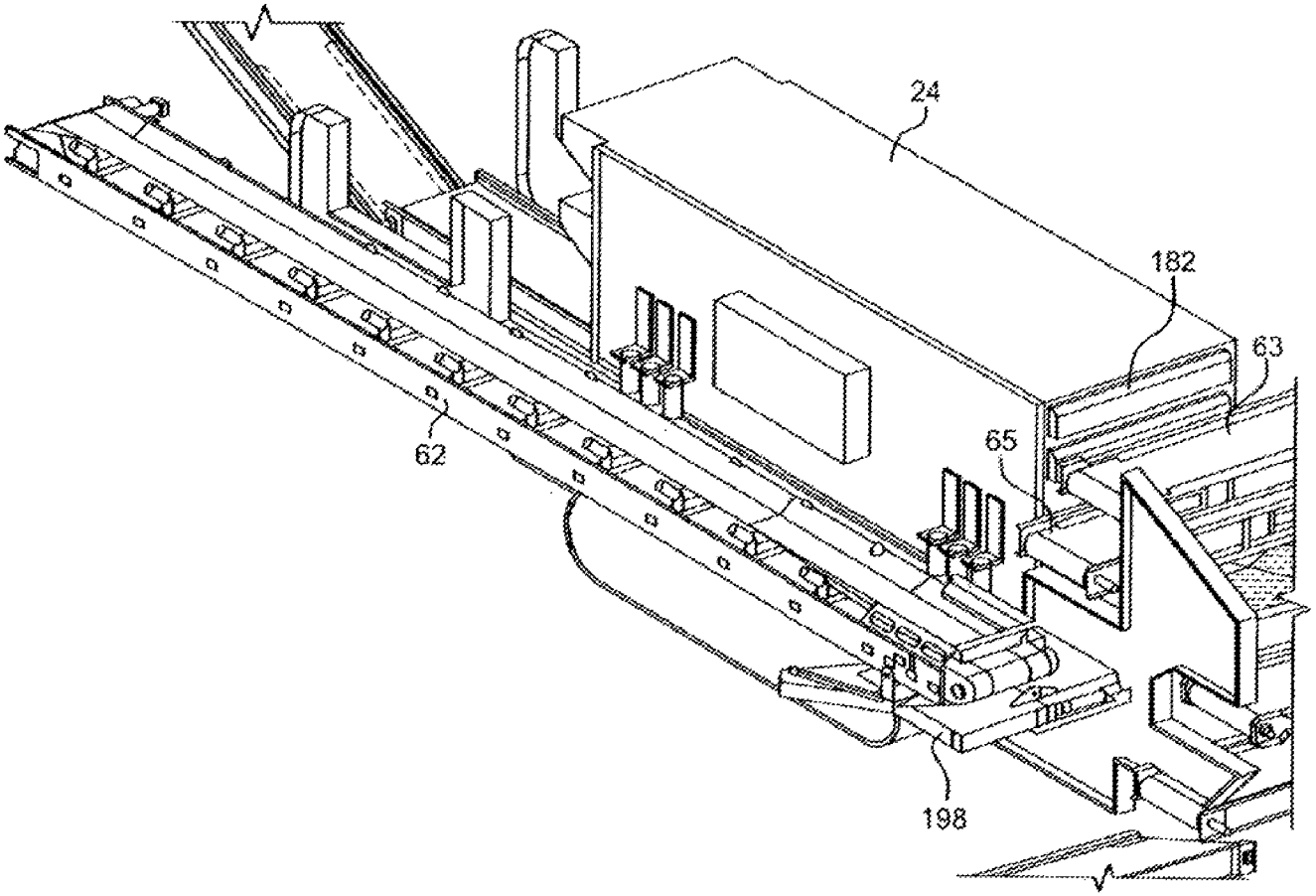
FIG. 37 shows a side view of the apparatus with a discharge conveyor in a partially stowed condition.

For stowage, the side conveyor 62 is rotated inwardly towards the screen box 24 into a position shown in FIG. 37. A hydraulic ram 220, or the like, can be provided between the carriage 214 and the base platform 198 so that rotation of the side conveyor 62 can be facilitated.

Figure 41:
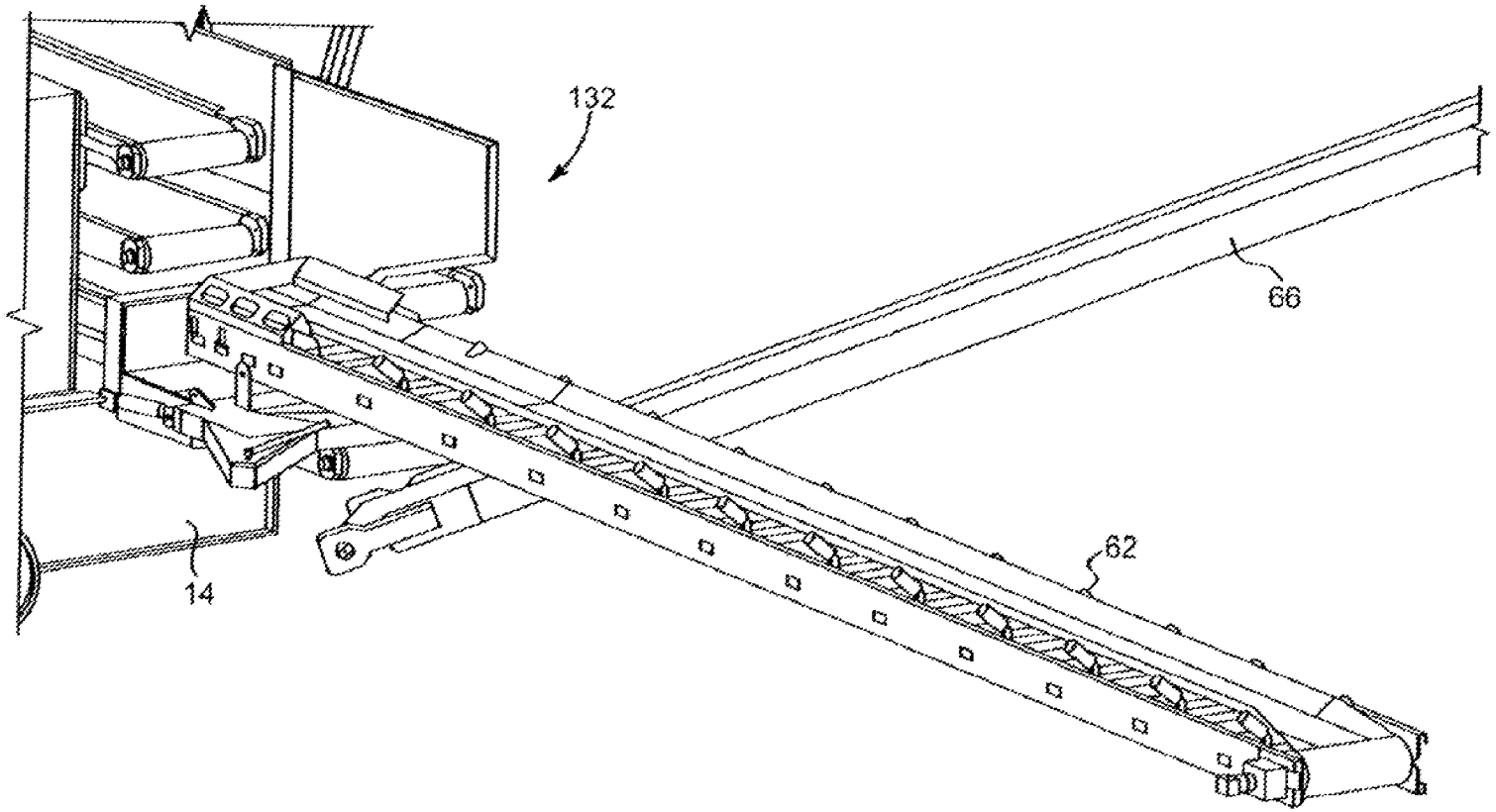
FIG. 41 shows two discharge conveyors in a partially deployed condition.

FIG. 41 shows the side conveyor 62 angled downwardly with respect to the support chassis 12. This can be part of a first step in stowing the side conveyor 62 prior to transport. Alternatively, this can be a position prior to adjusting the side conveyor 62 for operation.

Figure 42:
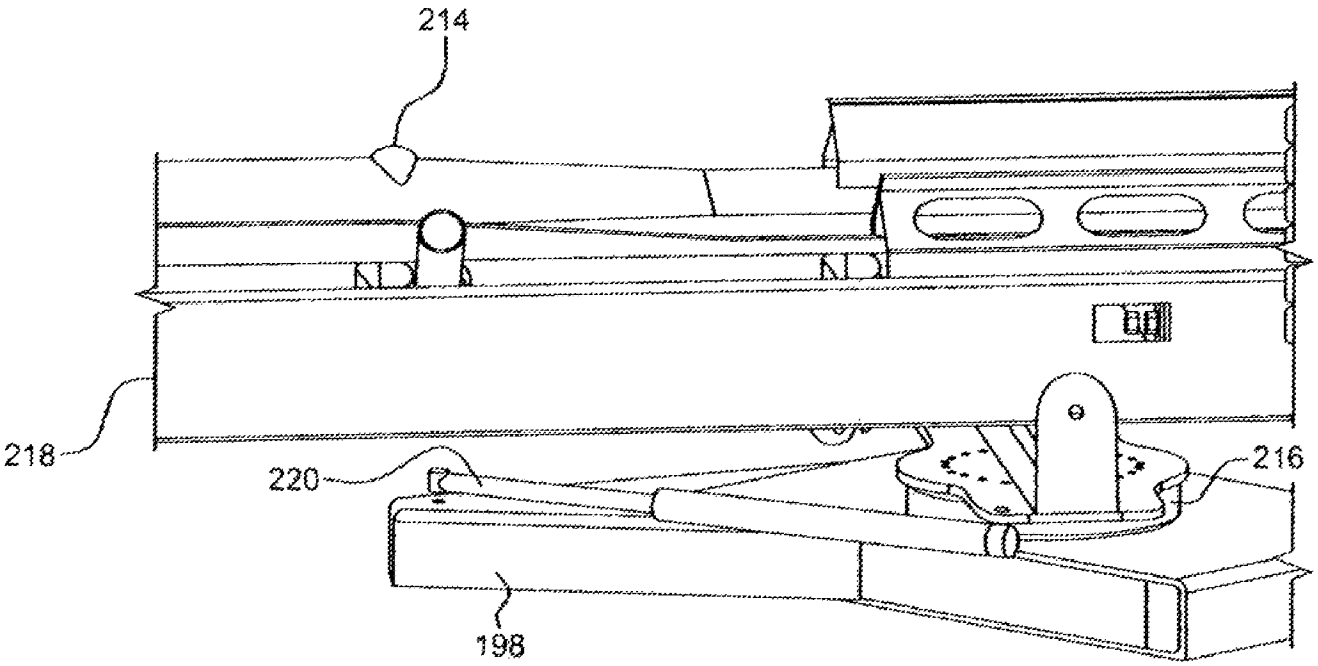
FIG. 42 shows a discharge conveyor in a generally horizontal orientation.

FIG. 42 shows another view of the manner in which the side conveyor 62 is mounted on the base platform 198. In this drawing, the side conveyor 62 is oriented generally horizontally.

Figure 43:
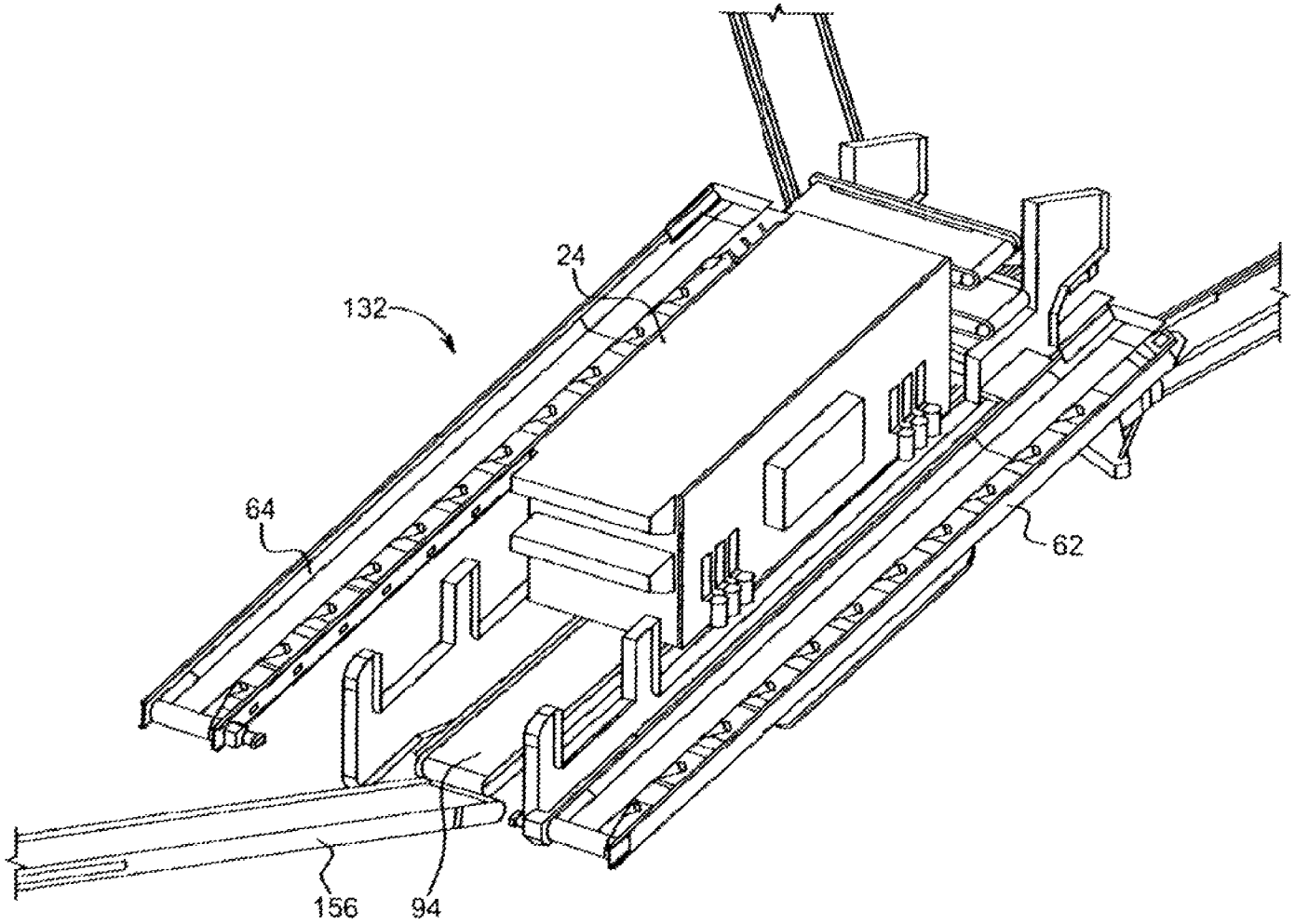
FIG. 43 shows a schematic three-dimensional view from above, with discharge conveyors in the form of side conveyors in a partially deployed condition.

FIG. 43 shows a schematic three-dimensional view from above of the apparatus 132. In this drawing, the conveyors 62, 64 are shown in a position just prior to being folded in towards the screen box 24. That position could also be a position prior to pivoting the conveyors 62, 64 outwardly away from the screen box 24.

Also in this drawing, the fines conveyor 94 can be seen beneath the screen box 24 to feed fines onto the conveyor 156.

Figure 44:
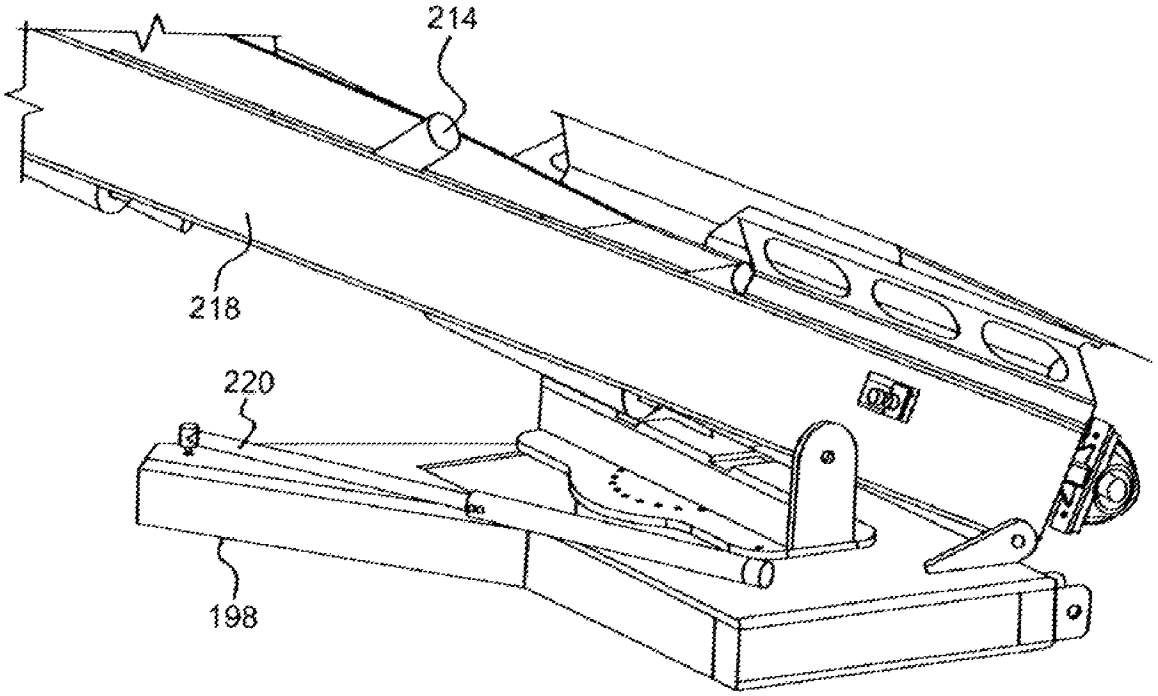
FIG. 44 shows a discharge conveyor in an inclined, operative condition.

FIG. 44 shows another view of the manner in which the side conveyor 62 is mounted on the base platform 198. In this drawing, the side conveyor 62 is oriented at an incline to be in an operational position.

Figure 45:
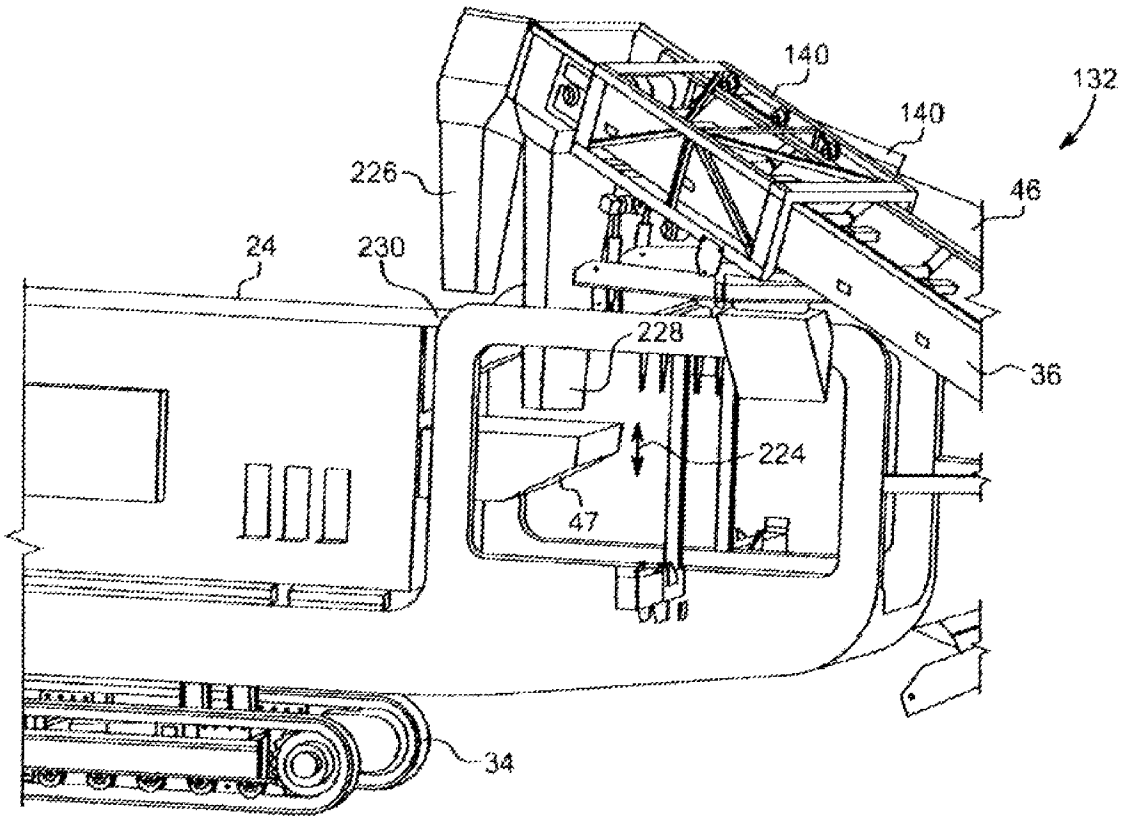
FIG. 45 shows a feed end of the apparatus with a transfer mechanism.

FIG. 45 shows some detail of a feed end of the apparatus 132. In particular, the drawing shows the feed chute 47 that is configured to move upwardly or downwardly, as indicated by the arrow 224, so that it can be brought into feed alignment with either of the intermediate decks 18, 20 or the bottom deck 22.

As can be seen, the primary feed conveyor 36 has a feed chute 226 that is positioned to feed material into a chute 230 for the top deck 16. The secondary feed conveyor 46 has a feed chute 228 that is positioned to feed material into the discharge chute 47.

Figure 46:
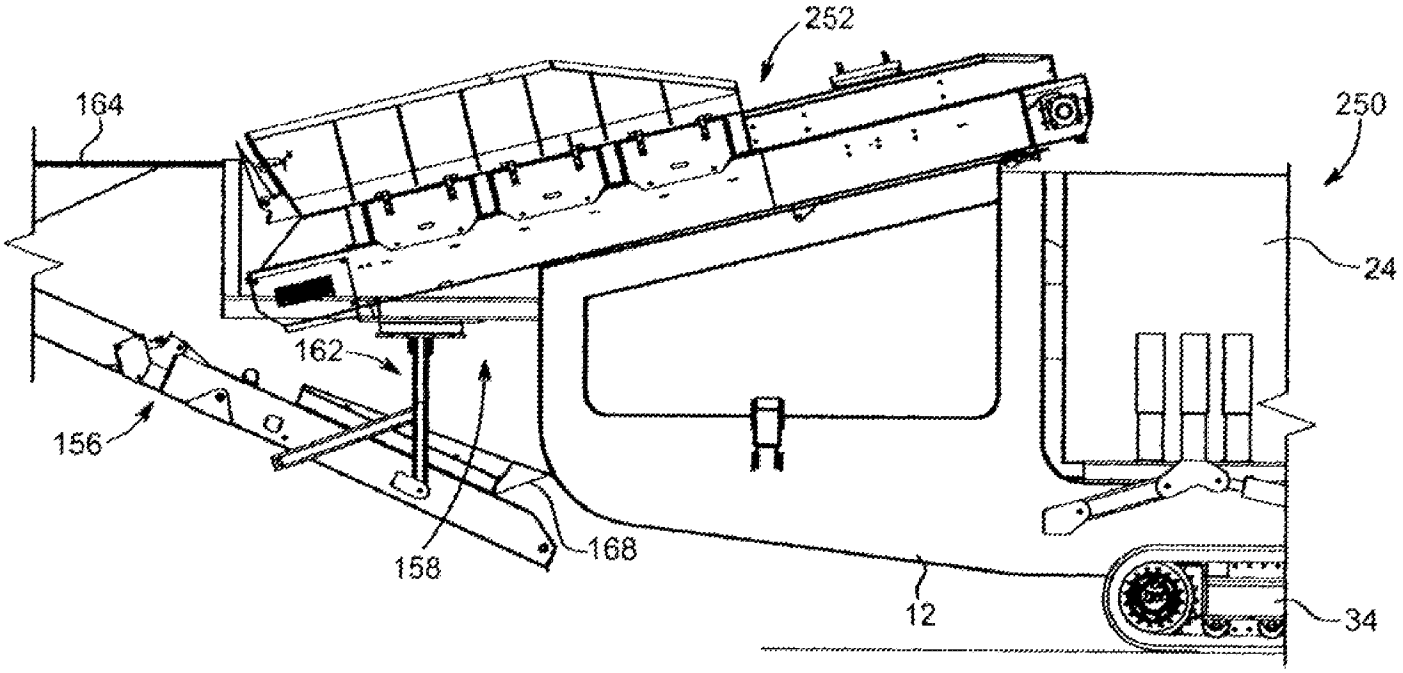
FIG. 46 shows a side view of a further example of a mobile screening apparatus incorporation a single feed mechanism.

FIG. 46 shows part of a mobile screening apparatus 250 that includes a single feed mechanism. In this example, the single feed mechanism is in the form of an apron feeder 252. However, it will be appreciated that other feed mechanisms can also be used. It will be appreciated that two such feed mechanisms can be provided, where required. These would operate to feed material to the decks, in the same manner as has been described with reference to the conveyors.

Figure 47:
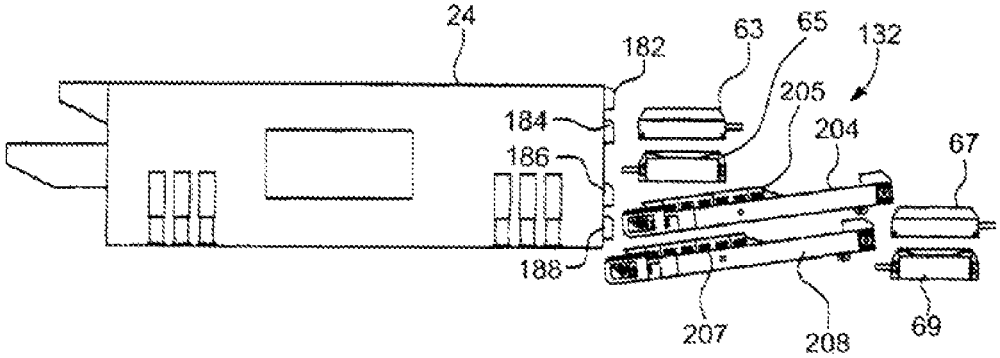
FIG. 47 shows a layout view of components of the apparatus of FIG. 25 for clarity.

FIG. 47 shows a further side layout view of the apparatus 132, showing particularly the transfer conveyor assembly 180 in further detail. The spacing of the conveyors 63, 65, 67 and 69 can clearly be seen. Also, the upper intermediate conveyor 204 has a feed hopper 205 to receive material from the lower intermediate deck 20. The lower intermediate conveyor 208 has a feed hopper 207 to receive material from the bottom deck 22.

Figure 48:
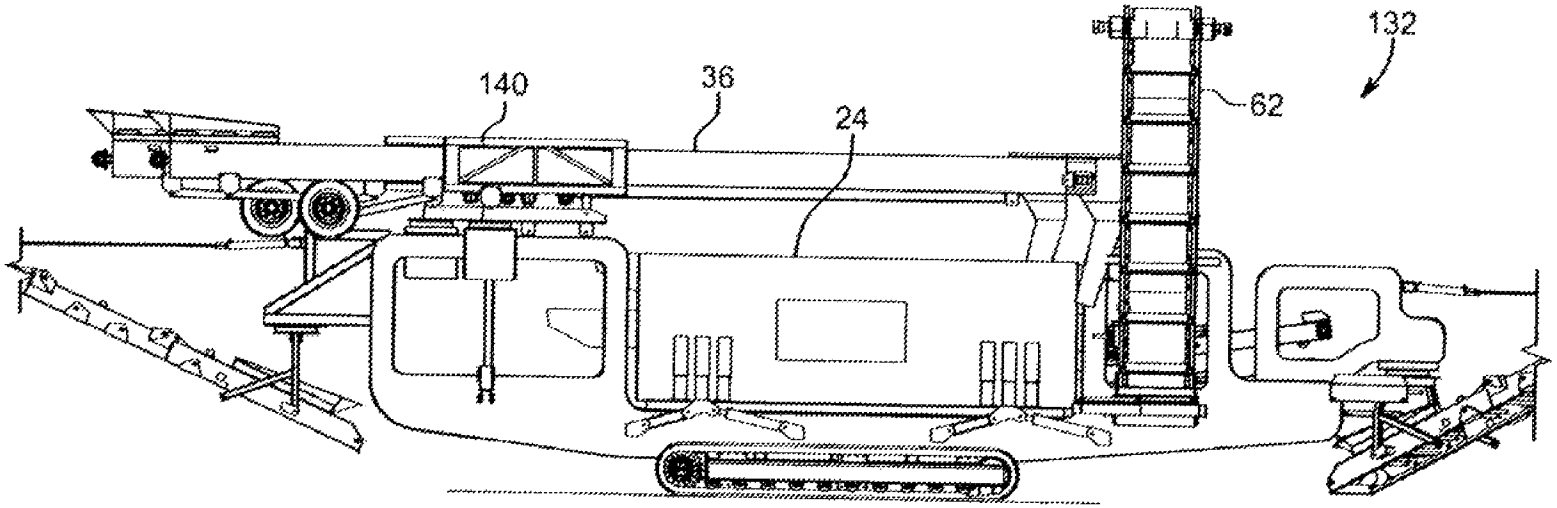
FIG. 48 shows a side view of the apparatus of FIG. 25 with the conveyors 36, 46 winched into a stowed condition.

FIG. 48 shows a side view of the apparatus 132. In this drawing, the conveyors 36, 46 are withdrawn through the winch boxes 140 to overlie the screen box 24 for transport.

As mentioned above, it has previously been impractical to provide a mobile screening apparatus that incorporates more than three screen decks. The primary reason for this is that such an apparatus would be of an excessive height and length with presently available feed systems to achieve effective screening. The apparatus provides a means whereby material can be fed to separate decks of a screen box, at the same time. As a result, a screening capacity of each deck is optimised, allowing a screen box of a reduced height and length to be provided while still having four decks.

The fact that the material is fed to selected decks from a rear of the screen box allows optimised use of each screen deck to achieve the various discharge products as described above. For example, the apparatus allows up to five separate products to be generated or discharged from the apparatus, depending on the use of intermediate crushers.

Throughout the specification, including the claims, where the context permits, the term "comprising" and variants thereof such as "comprise" or "comprises" are to be interpreted as including the stated integer or integers without necessarily excluding any other integers.

It is to be understood that the terminology employed above is for the purpose of description and should not be regarded as limiting. The described embodiments are intended to be illustrative of the invention, without limiting the scope thereof. The invention is capable of being practised with various modifications and additions as will readily occur to those skilled in the art.

The use of examples, or exemplary language (e.g., "such as") provided herein, is intended merely to better illuminate one or more embodiments and does not pose a limitation on the scope of any subject matter unless otherwise stated.

The use of the terms "a", "an", "said", "the", and/or similar referents in the context of describing various embodiments (especially in the context of the following claims) are to be construed to cover both the singular and the plural, unless otherwise indicated herein or clearly contradicted by context.

Moreover, when any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate subrange defined by such separate values is incorporated into the specification as if it were individually recited herein.

The invention claimed is:

1. A transfer conveyor assembly for a screening apparatus having a top screen deck, an upper intermediate screen deck, a lower intermediate screen deck and a bottom screen deck, the transfer conveyor assembly comprising:

a first transfer conveyor that is oriented transversely with respect to a feed direction of the screening apparatus and is configured to receive material from the top screen deck such that the material is stockpiled or fed to a further conveyor;

a second transfer conveyor that is oriented transversely with respect to the feed direction of the screening apparatus and is configured to receive material from the upper intermediate screen deck such that the material is stockpiled or fed to a further conveyor;

an upper intermediate transfer conveyor that is configured to convey material from the lower intermediate screen deck out from underneath the first and second transfer conveyors to a position away from the first and second transfer conveyors in a discharge direction of the screening apparatus;

a third transfer conveyor oriented transversely with respect to the feed direction of the screening apparatus, the upper intermediate conveyor being configured to discharge material onto the third transfer conveyor such that the material is stockpiled or fed to a further conveyor;

a lower intermediate transfer conveyor that is configured to convey material from the bottom screen deck out from underneath the first and second transfer conveyors to a position away from the first and second transfer conveyors in a discharge direction of the screening apparatus; and a fourth transfer conveyor oriented transversely with respect to the feed direction of the screening apparatus, the lower intermediate conveyor being configured to discharge material onto the fourth transfer conveyor such that the material is stockpiled or fed to a further conveyor.

2. The transfer conveyor assembly as claimed in claim 1, in which at least the upper intermediate transfer conveyor is angled upwardly from a feed end to a discharge end of the upper intermediate transfer conveyor.

3. The transfer conveyor assembly as claimed in claim 2, in which the lower intermediate transfer conveyor is angled downwardly from a feed end of the lower intermediate transfer conveyor to a discharge end of the lower intermediate transfer conveyor.

4. The transfer conveyor assembly as claimed in claim 1, in which the first and second transfer conveyors are positioned one above the other in general alignment with each other, and the third and fourth transfer conveyors are positioned one above the other in general alignment with each other.

5. The transfer conveyor assembly as claimed in claim 1, in which both the upper and lower intermediate transfer conveyors are angled upwardly from a feed end to a discharge end of the intermediate transfer conveyors.

6. A mobile screening apparatus that comprises:

a support chassis;

a screening assembly mounted on the support chassis, the screening assembly having a top screen deck, an upper intermediate deck, a lower intermediate deck and a bottom deck; and a transfer conveyor assembly that is configured for arrangement in communication with the screening assembly, the transfer conveyor assembly including:

a first transfer conveyor that is oriented transversely with respect to a feed direction of the screening apparatus and is configured to receive material from the top screen deck such that the material is stockpiled or fed onto a further conveyor;

a second transfer conveyor that is oriented transversely with respect to the feed direction of the screening apparatus and is configured to receive material from the upper intermediate screen deck such that the material is stockpiled or fed onto a further conveyor;

an upper intermediate transfer conveyor that is configured to convey material from the lower intermediate screen deck out from underneath the first and second transfer conveyors to a position away from the first and second transfer conveyors in a discharge direction of the screening apparatus, a third transfer conveyor oriented transversely with respect to the feed direction of the screening apparatus, the upper intermediate conveyor being configured to discharge material onto the third transfer conveyor such that the material is stockpiled or fed onto a further conveyor;

a lower intermediate transfer conveyor that is configured to convey material from the bottom screen deck out from underneath the first and second transfer conveyors to a position away from the first and second transfer conveyors in a discharge direction of the screening apparatus; and a fourth transfer conveyor oriented transversely with respect to the feed direction of the screening apparatus, the lower intermediate conveyor being configured to discharge material onto the fourth transfer conveyor such that the material is stockpiled or fed to a further conveyor.

7. The mobile screening apparatus as claimed in claim 6, which includes at least one conveyor that is arranged on the chassis and is positioned to receive material from at least one of the transfer conveyors.

8. The mobile screening apparatus as claimed in claim 6, which includes four discharge conveyors positioned to receive material from the respective transfer conveyors.

9. The mobile screening apparatus as claimed in claim 8, in which two of the four discharge conveyors are in operative communication with the first and second transfer conveyors, respectively, and in which a further two of the four discharge conveyors are in operative communication with the third and fourth transfer conveyors, respectively, so that one set of two discharge conveyors can be horizontally spaced from another set of two discharge conveyors.

10. A method of screening material with a mobile screening apparatus which has a support chassis, a screening assembly mounted on the support chassis, the screening assembly having a top screen deck, an upper intermediate screen deck, a lower intermediate screen deck, and a bottom screen deck, a transfer conveyor assembly that is configured for arrangement in communication with the screening assembly, the transfer conveyor assembly including a first transfer conveyor that is oriented transversely with respect to a feed direction of the screening apparatus and is configured to receive material from the top screen deck such that the material is stockpiled or fed to a further conveyor, a second transfer conveyor that is oriented transversely with respect to the feed direction of the screening apparatus and is configured to receive material from the upper intermediate screen deck such that the material is stockpiled or fed to a further conveyor, an upper intermediate transfer conveyor that is configured to convey material from the lower intermediate screen deck out from underneath the first and second transfer conveyors in a discharge direction of the screening apparatus, a third transfer conveyor oriented transversely with respect to the feed direction of the screening apparatus, the upper intermediate conveyor being configured to discharge material onto the third transfer conveyor such that the material is stockpiled or fed to a further conveyor, a lower intermediate transfer conveyor that is configured to convey material from the bottom screen deck out from underneath the first and second transfer conveyors in a discharge direction of the screening apparatus, and a fourth transfer conveyor oriented transversely with respect to the feed direction of the screening apparatus, the lower intermediate conveyor being configured to discharge material onto the fourth transfer conveyor such that the material is stockpiled or fed to a further conveyor, the method comprising the steps of:

feeding material to be screened onto at least one of the screen decks;

feeding material from the at least one of the screen decks on to at least one of the transfer conveyors; and feeding material from at least one of the screen decks to at least one of the intermediate conveyors.

* * * * *